US011830295B2

(12) United States Patent
Johnston et al.

(10) Patent No.: US 11,830,295 B2
(45) Date of Patent: Nov. 28, 2023

(54) DETERMINING VEHICLE SERVICE TIMEFRAMES BASED ON VEHICLE DATA

(71) Applicant: Verizon Patent and Licensing Inc., Basking Ridge, NJ (US)

(72) Inventors: Seth Allyn Johnston, Canton, GA (US); Diego Mondragon, Roswell, GA (US); Thomas James Lodato, Atlanta, GA (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 204 days.

(21) Appl. No.: 17/443,037

(22) Filed: Jul. 20, 2021

(65) Prior Publication Data

US 2021/0350635 A1 Nov. 11, 2021

Related U.S. Application Data

(63) Continuation of application No. 16/385,789, filed on Apr. 16, 2019, now Pat. No. 11,087,566.

(51) Int. Cl.
*G07C 5/00* (2006.01)
*G07C 5/08* (2006.01)

(52) U.S. Cl.
CPC ..... *G07C 5/006* (2013.01); *G07C 5/008* (2013.01); *G07C 5/0808* (2013.01)

(58) Field of Classification Search
None
See application file for complete search history.

(56) References Cited

U.S. PATENT DOCUMENTS 6,748,305 B1 * 6/2004 Klausner ..... G07C 5/006 702/182
9,466,153 B2 * 10/2016 Fischer ..... G07C 5/008
2004/0158367 A1 * 8/2004 Basu ..... G07C 5/006 701/31.9
2009/0118897 A1 * 5/2009 Schoeggl ..... G07C 5/0808 701/31.4
2012/0109418 A1 * 5/2012 Lorber ..... G06Q 40/08 701/1
2013/0244210 A1 * 9/2013 Nath ..... G09B 19/167 434/65
2014/0279707 A1 9/2014 Joshua et al.
2014/0303833 A1 * 10/2014 Phelan ..... B60W 40/09 701/31.5
2015/0152931 A1 6/2015 Moore et al.
(Continued)

*Primary Examiner* — Daniel L Greene

(57) ABSTRACT

A device receives vehicle data from a vehicle telematics device or a client device. The vehicle data includes information relating to a vehicle, a vehicle component, and a sensor associated with the vehicle. The device determines a vehicle profile, and one or more of a driving behavior and a driving location based on the vehicle data. The vehicle profile includes information relating to a condition of the vehicle component. The device determines a wear rate for the vehicle component based on the vehicle profile, and one or more of the driving behavior or the driving location. The device determines a service timeframe for the vehicle component based on the wear rate, the condition of the vehicle component, and a wear threshold. The device generates a recommendation based on the service timeframe, and transmit the recommendation to the client device.

20 Claims, 10 Drawing Sheets

(56) References Cited

U.S. PATENT DOCUMENTS

| | | | | |
|---|---|---|---|---|
| 2015/0262432 | A1* | 9/2015 | Yturriaga-Trenor ... | G07C 5/006 701/29.1 |
| 2016/0138665 | A1 | 5/2016 | Antanaitis et al. | |
| 2017/0067524 | A1 | 3/2017 | Horton | |
| 2017/0140652 | A1* | 5/2017 | Hodges ..... | G06F 3/04842 |
| 2019/0011004 | A1 | 1/2019 | Mettrick et al. | |
| 2019/0084548 | A1 | 3/2019 | Ohazulike | |
| 2019/0107163 | A1 | 4/2019 | Medinei et al. | |
| 2020/0164695 | A1* | 5/2020 | Kilaru ..... | B60C 11/246 |

* cited by examiner

DETERMINING VEHICLE SERVICE TIMEFRAMES BASED ON VEHICLE DATA

RELATED APPLICATION

This application is a continuation of U.S. patent application Ser. No. 16/385,789, entitled "DETERMINING VEHICLE SERVICE TIMEFRAMES BASED ON VEHICLE DATA," and filed Apr. 16, 2019, now U.S. Pat. No. 11,087,566, which is incorporated herein by reference in its entirety.

BACKGROUND

Vehicle telematics devices can be used to gather information about a vehicle and/or a driver of the vehicle. In general, vehicle telematics devices can access various data relating to the operation of the vehicle by interfacing with a vehicle communication interface of the vehicle (e.g., via a controller area network (CAN), an on-board diagnostics (OBD) port, and/or another information system within the vehicle). Vehicle telematics devices can also provide dedicated sensors or measurement devices adapted to gather additional data about the vehicle and/or driver, that may not otherwise be determined directly from the vehicle. Vehicle telematics devices can also send, receive, and/or store the data via a wired and/or wireless communication interface with a smart phone, a computer, a cellular network, and/or the like.

DETAILED DESCRIPTION OF PREFERRED EMBODIMENTS

Figure 1A:
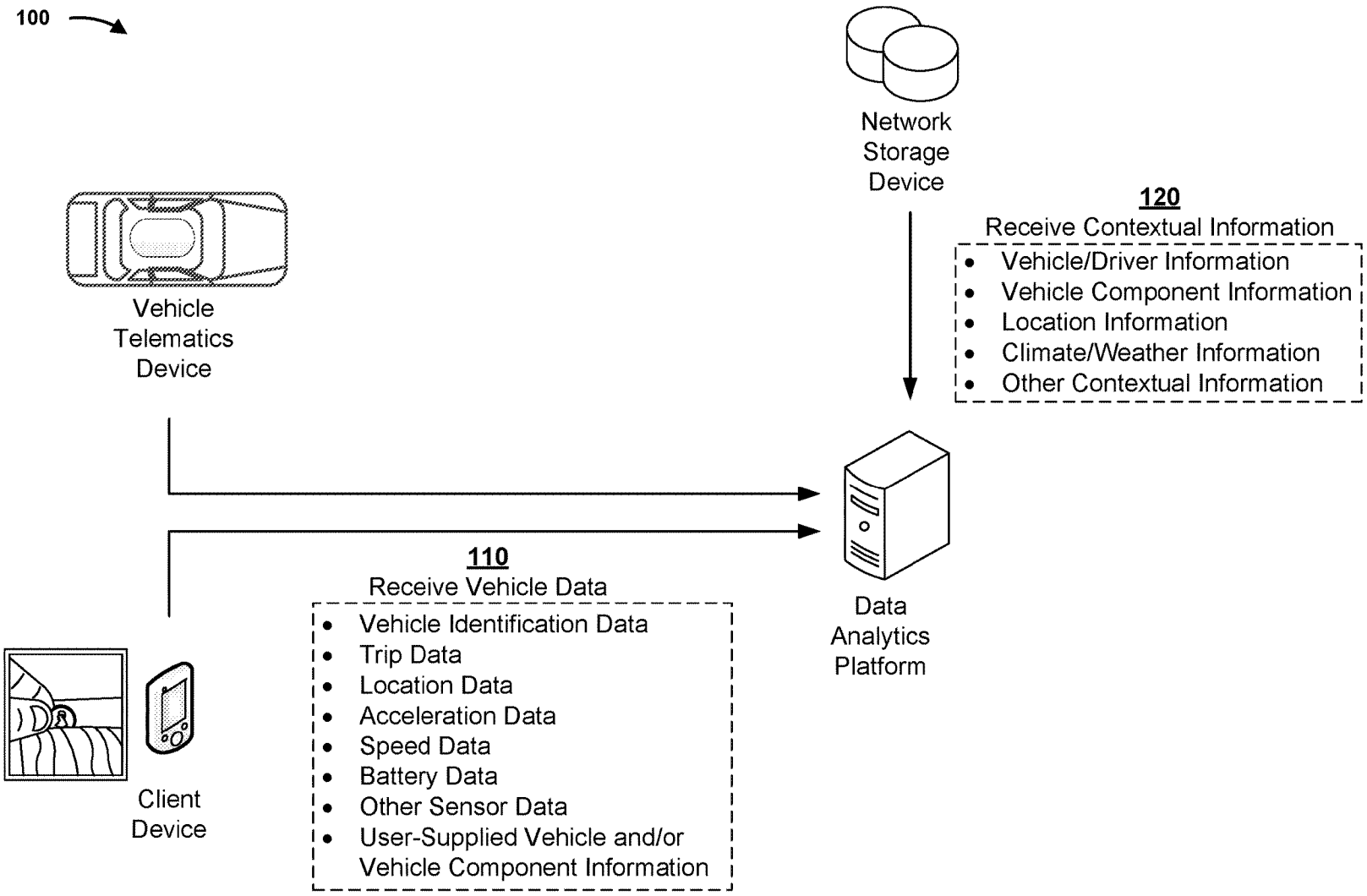
FIGS. 1A-1F are diagrams of one or more example implementations described herein.

The following detailed description of example implementations refers to the accompanying drawings. The same reference numbers in different drawings may identify the same or similar elements.

Timely vehicle maintenance is an important aspect of owning and operating a vehicle. Proper performance of a vehicle relies on the ability of different vehicle components to perform different functions of the vehicle. Many of the components of a vehicle are wear items that need to be serviced or replaced after a particular amount of use or at certain intervals, typically tracked in terms of distance driven and/or expiration of a time period. Some of the more common wear items of a vehicle may include, for example, tires, batteries, brake pads, brake rotors, wheel bearings, emission components, shock absorbers, and the like. Other common vehicle components that are regularly serviced may also include fluids, such as engine oil, transmission oil, coolant, brake fluid, and the like.

As such wear items deteriorate, various functions of the vehicle can suffer in terms of safety, performance, efficiency, and/or fuel economy. For instance, worn tires may provide less traction and reduce the ability to effectively stop or steer the vehicle, especially on wet or snowy road surfaces. Operating a vehicle with worn components may further adversely affect or accelerate the wear of other vehicle components that are otherwise in optimal condition. For instance, driving on worn tires for prolonged periods of time may accelerate the wear of wheel bearings, suspension components, transmission components, and/or other vehicle components. Prolonged use of worn brake pads may accelerate the wear of brake rotors, brake calipers, brake lines, and/or other related components. Furthermore, prolonged use of worn batteries may accelerate the wear of alternators and/or other electrical components.

While timely maintenance helps to keep the vehicle operating at optimal levels, it is often difficult to identify the appropriate time to service a particular vehicle component. General service intervals for some vehicle components may exist, but tend to be broadly defined and do not take into account factors specific to the vehicle and/or driver, such as driving behavior, driving location, local climate, and/or another factor that can significantly affect the actual wear of the particular vehicle component. For instance, a particular tire that is installed on a heavy vehicle, that is driven by an aggressive driver on unpaved roads in warmer climates, may have a significantly shorter life than when installed on a light vehicle, that is driven by a slow driver on paved roads in cooler climates. With such variance, following general service intervals may result in untimely vehicle service.

In some cases, a driver of a vehicle may independently monitor the actual wear of the vehicle components in between service intervals, and determine firsthand when service is needed. However, assessing the condition of a vehicle component is not always straightforward. The driver may need to research (e.g., query Internet resources via a computer or a mobile device) to understand when a vehicle component needs to be replaced, to select which replacement vehicle component fits the vehicle and the desired vehicle use, and/or to identify local service centers that are capable of replacing the particular vehicle component. The driver may also consult with a representative of a service center. However, the service center representative may also need to refer to internal resources (e.g., data stored on a network workstation and/or server) to determine the correct replacement component and verify fitment for the particular vehicle. Such research can be time-consuming and use computational and/or network resources (e.g., processing resources, memory resources, power resources, communication resources, and/or the like).

Some implementations described herein may provide a data analytics platform that automatically predicts more accurate and vehicle-specific service timeframes for different components of a vehicle. In some implementations, the data analytics platform may receive vehicle data, such as information relating to a vehicle, a vehicle component, and/or a sensor of the vehicle, from a vehicle telematics device, a client device, and/or another device. In some implementations, the data analytics platform may determine a vehicle profile and a driver profile based on the vehicle data. The vehicle profile may include information relating to a condition of the vehicle component and/or other information specific to the vehicle. The driver profile may include information relating to a driving behavior, a driving location, and/or other information specific to a driver of the vehicle.

In some implementations, the data analytics platform may determine a wear rate that is specific to the vehicle profile and the driver profile. Wear rate may refer to the rate at which a particular vehicle component deteriorates. For example, the wear rate for a tire may refer to the rate at which the tire tread depth diminishes as a function of time and/or distance, and the wear rate for a brake pad may refer to the rate at which the brake pad thickness diminishes as a function of time and/or distance. The wear rate for a battery may refer to the rate at which the output voltage of the battery decreases as a function of time and/or distance. In some implementations, the data analytics platform may determine a wear rate for a brake rotor, a wheel bearing, an emission component, a shock absorber, and/or another commonly serviced vehicle component. In some implementations, the data analytics platform may determine a wear rate (e.g., rate of deterioration, contamination, and/or depletion) of fluids, such as engine oil, transmission oil, coolant, brake fluid, and/or the like.

In some implementations, the data analytics platform may determine a service timeframe for the vehicle component based on the wear rate and a wear threshold associated with the vehicle component. In some implementations, the data analytics platform may generate recommendations to the driver of the vehicle to service the vehicle component within the service timeframe. In some implementations, the data analytics platform may identify a replacement component that matches the vehicle profile and/or the driver profile, and generate a recommendation based on the identified replacement component. In some implementations, the data analytics platform may identify a service center that is local to the driver and equipped to service the vehicle component, and generate a recommendation based on the identified service center.

In this way, the data analytics platform is able to provide better predictions about a vehicle without the drawbacks discussed above. By leveraging vehicle data that is specific to the vehicle, the vehicle components, and the driver of the vehicle, it is possible to determine accurate service timeframes for different vehicle components. By identifying more accurate service timeframes, the driver is able to promptly service worn vehicle components and prevent unnecessary wear to other vehicle components. Also, by maintaining the vehicle components in optimal condition, the driver is able to keep the vehicle operating safely, efficiently, and with better fuel economy. Furthermore, by automating many of the steps typically involved in researching and troubleshooting the condition of a vehicle component, drivers and/or service centers are able to conserve computational and network resources (e.g., processing resources, memory resources, power resources, communication resources, and/or the like).

FIGS. 1A-1F are diagrams of one or more example implementations 100 described herein. As shown in FIGS. 1A-1F, the example implementation(s) 100 may include a data analytics platform, a vehicle telematics device, a client device, and a network storage device. The data analytics platform may provide a maintenance tracking service that tracks a condition of a vehicle component, and predicts a service timeframe for the vehicle component. FIGS. 1A-1F present one or more functions that may be performed by the data analytics platform to provide the maintenance tracking service. For example, the data analytics platform may receive vehicle data, estimate a wear rate based on the vehicle data, and determine the service timeframe for the vehicle component based on the vehicle data. In some implementations, one or more of the functions, described as being performed by the data analytics platform, may be performed by another device, such as the client device.

In some implementations, the data analytics platform may enable a driver (e.g., a vehicle owner) to register for the maintenance tracking service using the client device (e.g., a smart phone, a mobile device, a computer, and/or the like). For example, the data analytics platform may enable the driver to use the client device to connect to the data analytics platform via a wired and/or a wireless connection, create a user account, and register for the maintenance tracking service. In some implementations, the data analytics platform may enable the driver to submit via the client device, during and/or after the registration process, information regarding the driver, the vehicle, the vehicle component, and/or the condition of the vehicle component. In some implementations, the data analytics platform may enable the driver to register the vehicle telematics device and/or the client device to be associated with the user account, the driver, and/or the vehicle.

In some implementations, the maintenance tracking service may be provided to the client device via a client application that is installed on the client device. In some implementations, the maintenance tracking service may be provided to the client device via a web-based application that is hosted by the data analytics platform. Using the maintenance tracking service, the driver may be able to specify when and/or how much of the vehicle data the data analytics platform should receive. For example, the driver may manually instruct the data analytics platform to start and/or stop receiving vehicle data from the vehicle telematics device and/or the client device at a desired interval. Additionally or alternatively, the driver may specify a condition under which the data analytics platform is to automatically start and/or stop receiving vehicle data (e.g., at a particular time, on a particular day, and/or based on another trigger). In some implementations, the maintenance tracking service may configure the vehicle telematics device and/or the client device to automatically store the vehicle data in a local memory, and enable the driver to manually select when and/or how much of the vehicle data to transmit to the data analytics platform.

As shown in FIG. 1A, and by reference number 110, the data analytics platform may receive the vehicle data from the vehicle telematics device and/or the client device. The vehicle data may include information that is supported by the vehicle telematics device and/or the client device and relates to the driver, the vehicle, the vehicle component, and/or the condition of the vehicle component. For example, the data analytics platform may receive vehicle data including vehicle identification data, trip data, location data, acceleration data, speed data, battery data, and/or other supported sensor data. Additionally or alternatively, the data analytics platform may receive user-supplied vehicle and/or vehicle component information in the form of textual data. In some implementations, the data analytics platform may receive user-supplied information in the form of image data, audio data, video data, and/or another format of data.

In some implementations, the vehicle telematics device may be in communication with the vehicle (e.g., coupled to a communication interface of the vehicle via an On-Board Diagnostics (OBD) port, and/or the like), and configured to read sensor information relating to an electrical system, a mechanical system, an emission system, and/or another system of the vehicle. Additionally or alternatively, the vehicle telematics device may include one or more sensors (e.g., an accelerometer, a gyroscope, a global positioning system (GPS) sensor, a magnetometer, a proximity sensor, a barometer, a camera, an audio sensor, a temperature sensor, and/or the like) that are separate from the vehicle, but configured to monitor usage of the vehicle. In some implementations, the vehicle telematics device may be integrated within the vehicle (e.g., via an infotainment system, a navigation system, and/or the like).

In some implementations, the client device may be associated with the driver of the vehicle and provide a user interface configured to receive user-supplied information. For example, the client device may receive information regarding the vehicle (e.g., a vehicle identification number (VIN), a make, a model, a model year, a trim, a classification, a drive type, and/or another attribute of the vehicle). In some implementations, the client device may receive information regarding the vehicle component (e.g., a part brand, a part model, a part number, a dimension, a performance rating, and/or another attribute of the vehicle component). In some implementations, the client device may include one or more sensors (e.g., an accelerometer, a gyroscope, a GPS sensor, a magnetometer, a proximity sensor, a barometer, a camera, an audio sensor, a temperature sensor, and/or the like) that are configured to monitor usage of the vehicle.

In some implementations, the client device may be configured to receive information regarding the vehicle, the vehicle component, and/or the condition of the vehicle component from the driver in the form of textual data. For example, the client device may enable the driver to enter information regarding the vehicle (e.g., a VIN, a make, a model, a model year, a trim, a classification, a drive type, and/or the like) into a text field. In some implementations, the client device may enable the driver to enter information regarding the vehicle component (e.g., a part brand, a part model, a part number, a dimension, a performance rating, and/or another attribute of the vehicle component) into a text field. In some implementations, the client device may enable the driver to enter information regarding the condition of the vehicle component (e.g., a physical dimension, a physical appearance, an electrical property, and/or another property indicative of the condition of the vehicle component) into a text field.

In some implementations, the client device may be configured to receive information regarding the vehicle, the vehicle component, and/or the condition of the vehicle component from the driver in the form of image data. For example, the client device may enable the driver to capture a digital image of the vehicle and/or the vehicle component. In some implementations, the client device may enable the driver to capture a digital image of a unique identifier associated with the vehicle and/or the vehicle component (e.g., the VIN, a quick response (QR) code, a barcode, and/or the like), which may be interpreted as information regarding the vehicle and/or the vehicle component (e.g., using optical character recognition (OCR), a VIN decoder, a QR code decoder, a barcode decoder, and/or the like). In some implementations, the client device may interpret the unique identifier, and transmit the underlying information to the data analytics platform. In some implementations, the client device may transmit image data of the unique identifier to the data analytics platform, and the data analytics platform may interpret the unique identifier to obtain the underlying information.

In some implementations, the client device may be configured to receive information regarding the condition of the vehicle component from the driver in the form of image data. For example, the client device may enable the driver to capture a digital image of the vehicle component in proximity to a reference object. The condition of the vehicle component may be derived based on an image-based analysis of the vehicle component and the reference object. In the case of a tire, as shown for example in FIG. 1A, the driver may capture a digital image of a tire tread in proximity to a reference object having a particular dimension (e.g., using a coin test). The client device may use a component condition model (e.g., a computer vision model, and/or another type of image-based analytic model) to determine a tire tread depth based on the digital image. For example, the component condition model may be trained to estimate the tire tread depth based on an image-based analysis of the tire tread and a particular dimension of the reference object.

In some implementations, the component condition model may be trained to estimate a condition of another vehicle component (e.g., a brake pad, a battery, a brake rotor, a suspension component, and/or the like) based on an image-based analysis of a digital image of the vehicle component and possibly also a reference object having a particular dimension. In some implementations, the component condition model may employ an image-based analysis of multiple digital images and/or a video of the vehicle component shown with or without a reference object. In some implementations, the component condition model may be stored within the client device, the data analytics platform, and/or otherwise accessible to the client device and/or the data analytics platform. In some implementations, the data analytics platform may receive image data relating to the digital image of a vehicle component, and use the component condition model to estimate the condition of the vehicle component.

In some implementations, the client device may be configured to receive information regarding the condition of the vehicle component from the driver in the form of audio data, and the component condition model may be configured to perform an audio-based analysis of the vehicle component. For example, the client device may enable the driver to capture an audio recording of operation of the vehicle component. The component condition model may be trained to analyze the audio recording, and identify a specific property (e.g., a noise level, a pitch, a pattern, and/or the like) in the audio recording. Based on a property identified in the audio recording, the component condition model may estimate the condition of the vehicle component. In some implementations, the component condition model may be trained using a reference audio file associated with the vehicle component. In some implementations, the component condition model may be stored within the client device. In some implementations, the data analytics platform may receive audio data relating to the vehicle component, and use the component condition model to estimate the condition of the vehicle component.

As further shown in FIG. 1A, and by reference number 120, the data analytics platform may optionally or additionally receive contextual information from a network storage device. In some implementations, the network storage device may store reference data (e.g., a vehicle record, a service record, a maintenance record, a vehicle catalogue, a part diagram, a driving record, map data, traffic data, weather data, and/or the like). In some implementations, the network storage device may implement an application programming interface (API) that enables the network storage device to access service history data (e.g., a service history feed) from a service center (e.g., a dealership service center, a repair facility, and/or the like). In some implementations, the network storage device may be managed by the data analytics platform. In some implementations, the network storage device may be accessible to the data analytics platform, but separately managed by a third-party associated with a service for maintaining the reference data.

In some implementations, the data analytics platform may use the vehicle data in conjunction with available contextual information to determine information regarding the vehicle, the vehicle component, and/or the condition of the vehicle component. Information regarding the vehicle may include a make, a model, a model year, a trim, a classification (e.g., convertible, coupe, sedan, minivan, sport utility vehicle, truck, or other classification), a drive type (e.g., front-wheel drive, rear-wheel drive, all-wheel drive, or other drive type), and/or the like. Information regarding the vehicle component may include a part brand, a part model, a part number, a dimension, a performance rating, a manufacturer-specified wear rate, a wear rate specified by a regulatory agency, and/or the like. Information regarding the condition of the vehicle component may include a physical dimension, a physical appearance, an electrical property, and/or the like.

In some implementations, the data analytics platform may determine information regarding the vehicle using the vehicle data. For example, the vehicle data may include information submitted by the driver via the client device (e.g., user-supplied information) providing information regarding the vehicle. In some implementations, if the vehicle data is insufficient to identify information regarding the vehicle, the data analytics platform may refer to the reference data (e.g., via the network storage device) for contextual information relating to the vehicle. For example, the data analytics platform may identify a VIN of the vehicle provided within the vehicle data, and use the VIN to query the reference data (e.g., using a vehicle record, a vehicle catalogue, and/or the like) to determine information regarding the vehicle.

In some implementations, the data analytics platform may determine information regarding the vehicle component using the vehicle data. For example, the vehicle data may include information submitted by the driver via the client device (e.g., user-supplied information) providing information regarding the vehicle component. In some implementations, if the vehicle data is insufficient to identify information regarding the vehicle component, the data analytics platform may refer to the reference data (e.g., via the network storage device) for contextual information relating to the vehicle component. For example, the data analytics platform may identify a VIN of the vehicle provided within the vehicle data, and use the VIN to query the reference data (e.g., using a service record, a maintenance record, a vehicle catalogue, a part diagram, and/or the like) to determine information regarding the vehicle component.

In some implementations, the data analytics platform may determine information regarding the condition of the vehicle component using the vehicle data. For example, the vehicle data may include information submitted by the driver via the client device (e.g., user-supplied information relating to a tire tread depth, a brake pad thickness, a battery output voltage, and/or the like), and/or information provided by the vehicle telematics device (e.g., a battery output voltage) indicative of the condition of the vehicle component. In some implementations, if the vehicle data is insufficient to identify the condition of the vehicle component, the data analytics platform may refer to reference data (e.g., via the network storage device) for contextual information relating to the condition of the vehicle component. For example, if the network storage device has access to a service history feed from a service center (e.g., a dealership service center, a repair facility, and/or the like), the data analytics platform may receive information regarding the condition of the vehicle component (e.g., a date and/or an odometer reading of when the vehicle component was last serviced, and/or a reported condition of the vehicle component at the time of service).

In some implementations, the data analytics platform may use the vehicle data in conjunction with available contextual information to determine information regarding the driving behavior of the driver, and/or information regarding the driving location of the driver. Information regarding the driving behavior may identify an over-speeding event, a hard-acceleration event, a hard-braking event, an average distance driven per time interval, an average speed per time interval, and/or the like. Information regarding the driving location may identify a geographical location of the driver or the vehicle, a place of interest (POI), a driven route, a local speed limit, a climate condition, a road condition, a traffic condition, a construction activity, and/or the like.

In some implementations, the data analytics platform may determine driving behavior relating to an over-speeding event. The data analytics platform may identify an over-speeding event using the vehicle data in conjunction with contextual information. For example, the data analytics platform may identify a vehicle speed based on speed data provided within the vehicle data, and/or a derivation based on a change in the location data (e.g., GPS data) as a function of time. In some implementations, the data analytics platform may use the location data to search the reference data (e.g., map data, traffic data, and/or the like) for a corresponding road segment and/or a speed limit for the road segment. The data analytics platform may identify an over-speeding event if the vehicle speed on the road segment exceeds the speed limit.

In some implementations, the data analytics platform may determine driving behavior relating to a number of over-speeding events identified within a particular time interval. For example, the driving behavior may be determined to be aggressive if the number of over-speeding events within the particular time interval satisfies a particular upper speeding event threshold. The driving behavior may be determined to be normal if the number of over-speeding events within the particular time interval satisfies a particular lower speeding event threshold, but does not satisfy the upper speeding event threshold. The driving behavior may be determined to be conservative if the number of over-speeding events identified within the particular time interval does not satisfy the lower speeding event threshold. In some implementations, the data analytics platform may identify an over-speeding event using varying levels of granularity.

In some implementations, the data analytics platform may determine driving behavior relating to a hard-acceleration event and/or a hard-braking event identified within the vehicle data. For example, the data analytics platform may determine an acceleration event or a deceleration event based on the acceleration data and/or a derivation based on a change in the speed data as a function of time. An acceleration event that satisfies a particular acceleration threshold may be defined as a hard-acceleration event, and a deceleration event that satisfies a particular deceleration threshold may be defined as a hard-braking event. In some implementations, the data analytics platform may determine or adjust the acceleration threshold and/or the deceleration threshold based on a vehicle weight, a tire pressure, a tire condition, a local temperature, a road condition, a climate condition, and/or the like.

In some implementations, the data analytics platform may determine driving behavior relating to a number of hard-acceleration events and/or a number of hard-braking events identified within a particular time interval. For example, the driving behavior may be determined to be aggressive if the number of hard-acceleration events and/or hard-braking events within the particular time interval satisfies a particular upper acceleration event threshold. The driving behavior may be determined to be normal if the number of hard-acceleration events and/or hard-braking events within the particular time interval satisfies a particular lower acceleration event threshold, but does not satisfy the upper acceleration event threshold. The driving behavior may be determined to be conservative if the number of hard-acceleration events and/or hard-braking events found within the particular time interval does not satisfy the lower acceleration event threshold. In some implementations, the data analytics platform may identify a hard-acceleration event and/or a hard-braking event using varying levels of granularity.

In some implementations, the data analytics platform may determine driving behavior relating to a hard-cornering event identified within the vehicle data. The data analytics platform may identify a hard-cornering event using speed data, acceleration data, and/or location data provided within the vehicle data. For example, the data analytics platform may identify a hard-cornering event if the acceleration data exhibits a lateral acceleration that satisfies a particular cornering acceleration threshold. In some implementations, the data analytics platform may adjust the cornering acceleration threshold for a particular corner based on certain attributes of the corner. For example, the data analytics platform may use the location data (e.g., GPS data) to query the reference data (e.g., map data, and/or the like) to determine a geometric feature of the corner (e.g., a turn-radius of the corner, a width of the corner, and/or a width of a connected road segment), and determine the cornering acceleration threshold based on the geometric feature.

In some implementations, the data analytics platform may identify a hard-cornering event based on speed data and location data provided within the vehicle data. For example, the data analytics platform may use the location data (e.g., GPS data) and the reference data (e.g., map data, and/or the like) to locate a corner along a driven route of the driver. The data analytics platform may determine a cornering speed of the vehicle (e.g., using speed data recorded at the location of the corner). The data analytics platform may identify a hard-cornering event if the cornering speed satisfies a particular cornering speed threshold. In some implementations, the data analytics platform may identify a hard-cornering event based on steering input data provided by the vehicle telematics device (e.g., in terms of a rate of change in steering input angle as a function of time).

In some implementations, the data analytics platform may determine driving behavior relating to a number of hard-cornering events identified within a particular time interval. For example, the driving behavior may be determined to be aggressive if the number of hard-cornering events within the particular time interval satisfies a particular upper cornering event threshold. The driving behavior may be determined to be normal if the number of hard-cornering events within the particular time interval satisfies a particular lower cornering event threshold, but does not satisfy the upper cornering event threshold. The driving behavior may be determined to be conservative if the number of hard-cornering events identified within the particular time interval does not satisfy the lower cornering event threshold. In some implementations, the data analytics platform may identify a hard-cornering event using varying levels of granularity.

In some implementations, the data analytics platform may determine the driving behavior based on vehicle usage. For example, the data analytics platform may determine the driving behavior based on an average daily distance driven by the driver. The average daily distance driven may be calculated based on trip data, location data, and/or other sensor data within a particular time interval of the vehicle data. In some implementations, the average daily distance driven may be calculated based on an aggregate of distance driven within a 24-hour period, a calendar day, and/or the like. In some implementations, the distance driven may be calculated based on a change in location data (e.g., GPS data). In some implementations, the distance driven may be calculated based on a difference in a vehicle odometer reading (e.g., provided by the vehicle telematics device). In some implementations, the data analytics platform may determine an average weekly distance driven, an average monthly distance driven, an average yearly distance driven, and/or the like. In some implementations, the data analytics platform may determine an average distance driven per trip based on an aggregate of trip data (e.g., provided by the vehicle telematics device).

In some implementations, the data analytics platform may determine the vehicle usage to be high if the average daily distance driven and/or average distance driven per trip satisfies a particular upper usage threshold. The data analytics platform may determine the vehicle usage to be moderate if the average daily distance driven and/or average distance driven per trip satisfies a particular lower usage threshold, but does not satisfy the upper usage threshold. The data analytics platform may determine the vehicle usage to be low if the average daily distance driven and/or average distance driven per trip does not satisfy the lower usage threshold. In some implementations, the data analytics platform may identify a degree of vehicle usage using varying levels of granularity.

In some implementations, the data analytics platform may determine the driving behavior based on an average daily speed. In some implementations, the average daily speed may be calculated based on speed data, and/or a derivation based on a change in location data as a function of time, observed within a 24-hour period, a calendar day, and/or the like. In some implementations, the average daily speed may be prorated based on a sample of vehicle data collected within a portion of a 24-hour period and/or calendar day. In some implementations, the data analytics platform may determine an average weekly speed, an average monthly speed, an average yearly speed, and/or the like. In some implementations, the data analytics platform may determine an average trip speed calculated based on an aggregate of vehicle speeds observed per trip.

In some implementations, the driving behavior may be determined to be aggressive if the average daily speed and/or the average trip speed satisfies a particular upper average speed threshold. The driving behavior may be determined to be normal if the average daily speed and/or the average trip speed satisfies a particular lower average speed threshold, but does not satisfy the upper average speed threshold. The driving behavior may be determined to be conservative if the average daily speed and/or the average trip speed does not satisfy the lower average speed threshold. Additionally or alternatively, the data analytics platform may determine the driving behavior based on minimum vehicle speeds, maximum vehicle speeds, and/or the like.

In some implementations, the data analytics platform may determine information regarding the driving location based on the vehicle data and the available contextual information. For example, the data analytics platform may use location data (e.g., GPS data) within the vehicle data to search the reference data (e.g., using map data, and/or the like) for a corresponding geographical location. For example, the data analytics platform may identify a road segment typically used by the driver (e.g., an expressway, a highway, an urban roadway, a suburban roadway, a rural roadway, an off-road or unpaved roadway, and/or the like). In some implementations, the data analytics platform may use the location data to search the reference data (e.g., using map data, traffic data, weather data, and/or the like) for a climate condition, a road condition, a traffic condition, a construction activity, and/or other contextual information. For example, the data analytics platform may identify a typical climate condition (e.g., rainy, snowy, cold, and/or hot) for the road segment based on the geographical location of the road segment and a time of year.

Figure 1B:
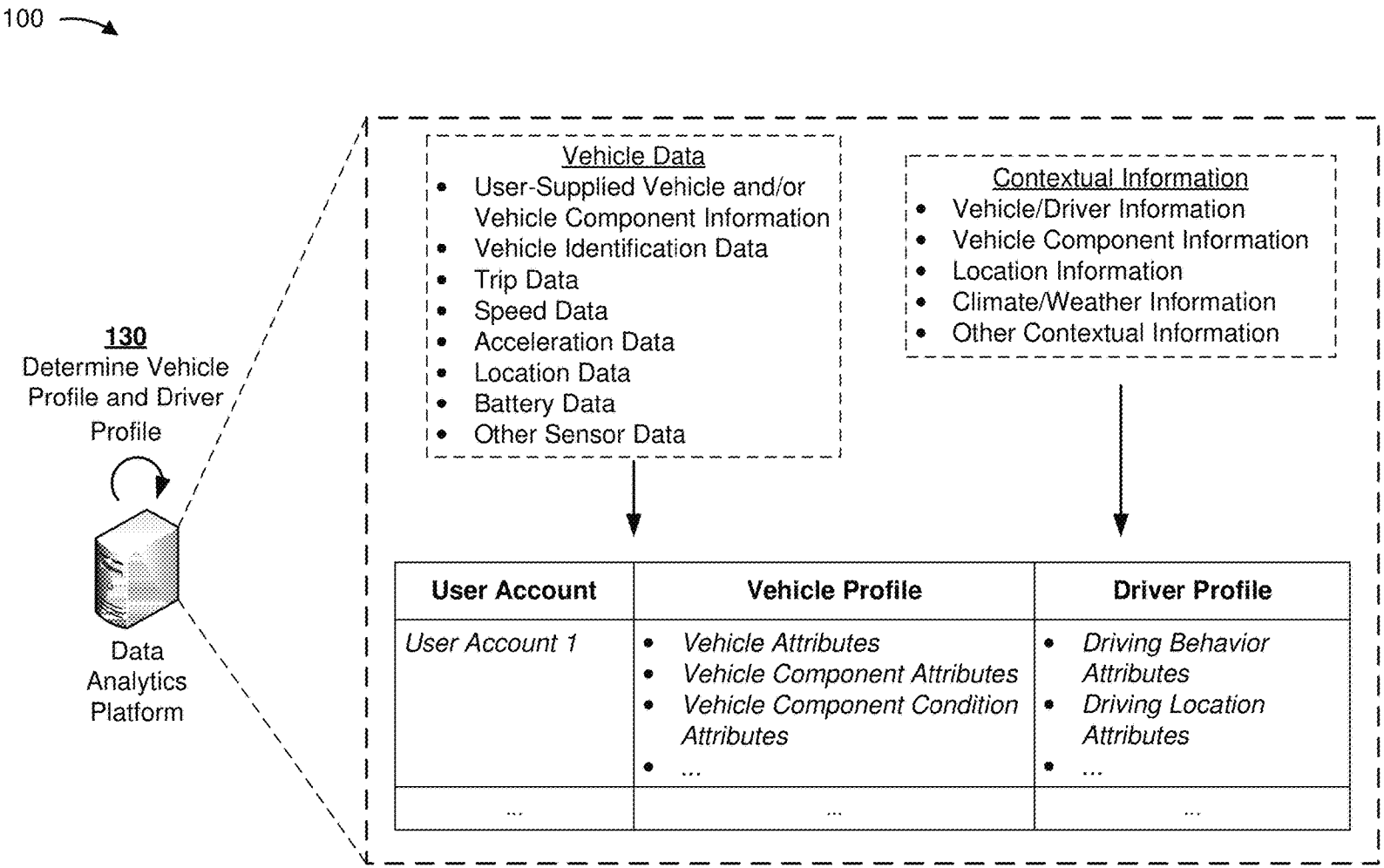

As shown in FIG. 1B, and by reference number 130, the data analytics platform may determine a vehicle profile and a driver profile. In some implementations, the data analytics platform may store, as attributes within the vehicle profile, information regarding the vehicle, information regarding the vehicle component, and/or information regarding a condition of the vehicle component, as previously discussed. In some implementations, the data analytics platform may store, as attributes within the driver profile, information regarding the driving behavior of the driver and/or information regarding the driving location of the driver, as previously discussed. The data analytics platform may associate the vehicle profile and the driver profile with a user account (e.g., a user account associated with the client device and/or the driver of the vehicle). In some implementations, the data analytics platform may store multiple user accounts, each being associated with a separate vehicle profile and/or a separate driver profile (e.g., multiple user accounts associated with multiple vehicle profiles and the same driver profile, multiple user accounts associated with multiple driver profiles and the same vehicle profile, and/or the like). In some implementations, the data analytics platform may update one or more of the user accounts, vehicle profiles, and/or driver profiles periodically and/or intermittently.

Figure 1C:
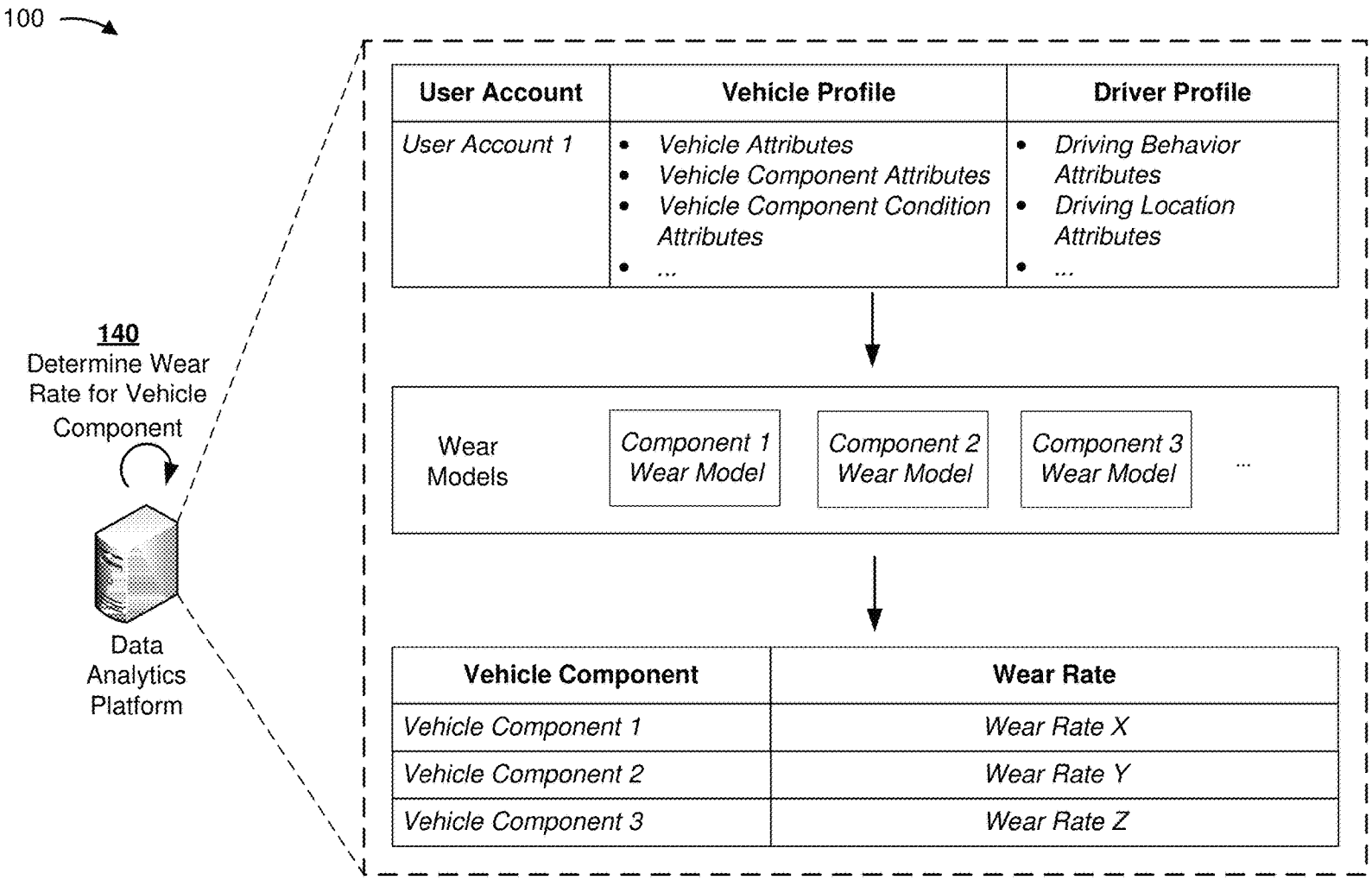

As shown in FIG. 1C, and by reference number 140, the data analytics platform may determine a wear rate for a vehicle component. For example, the data analytics platform may input the vehicle profile and/or the driver profile into a wear model that is trained to estimate the wear rate for the vehicle component based on one or more attributes within the vehicle profile and/or the driver profile. In some implementations, the wear model may be stored within the data analytics platform, and/or otherwise made accessible to the data analytics platform. In some implementations, the data analytics platform may use a different wear model for each vehicle component. For example, the data analytics platform may use a first wear model for determining a wear rate for a tire, a second wear model for determining a wear rate for a brake pad, a third wear model for determining a wear rate for a battery, and/or the like. In some implementations, a single wear model may estimate wear rates for more than one vehicle component.

In some implementations, the wear model may be trained to estimate the wear rate of a vehicle component based on a difference between a prior condition of the vehicle component and a current condition of the vehicle component, time elapsed since the prior condition, distance driven since the prior condition, and/or another attribute included in the vehicle profile and/or the driver profile. In some implementations, the wear model may identify the prior condition of the vehicle component based on an attribute of the vehicle profile, and identify the current condition of the vehicle component based on an attribute within the vehicle profile. In some implementations, if the current condition is unavailable, the wear model may use attributes from two or more prior conditions of the vehicle component, and estimate the current condition of the vehicle component based on the attributes.

The wear model may compare the prior condition and the current condition of the vehicle component, and quantify the difference (e.g., in terms of a physical dimension, a physical appearance, an electrical property, and/or another quantifiable property). The wear model may estimate the wear rate as a ratio between the difference in condition and the time elapsed since the prior condition, and/or as a ratio between the difference in condition and distance driven since the prior condition. In some implementations, the wear model may estimate the wear rate based on other available attributes available in the vehicle profile (e.g., a manufacturer-specified wear rate, a wear rate specified by a regulatory agency, and/or the like). In some implementations, the wear model may estimate the wear rate based on two or more prior conditions of the vehicle component.

In some implementations, the wear model may be trained to determine the estimated wear rate based on an attribute associated with a driving behavior, a driving location, a climate condition, a road condition, and/or the like. For example, the wear model may increase the estimated wear rate if the driver is an aggressive driver who frequently drives on urban roads in a city with extreme climates. Alternatively, the wear model may decrease the estimated wear rate if the driver is a conservative driver who drives on paved rural roads in mild climates. The wear model may be trained to use different weighting factors for each attribute based on relevance to the wear rate of the particular vehicle component. For example, a hard-acceleration event may have more direct impact on tire wear than on battery wear. Accordingly, the wear model may assign greater weight to a hard-acceleration event for tire wear rate estimations than for battery wear rate estimations.

As one example, the wear model may be trained to estimate the wear rate of a tire. The wear model may determine a prior condition (e.g., prior tire tread depth) of the tire based on an attribute within the vehicle profile (e.g., an attribute of the vehicle component derived from a service record and/or a maintenance record). For example, the prior condition may be determined based on when the tire was first installed (e.g., associated with a service date and a reported odometer reading of the vehicle). The wear model may determine a current condition (e.g., current tire tread depth) of the tire based on an attribute within the vehicle profile (e.g., an attribute of the condition of the vehicle component derived from user-supplied information). The wear model may quantify the difference in tire tread depth between the prior tread depth and the current tread depth, and estimate the tire wear rate as a ratio between the difference and the time elapsed since the prior condition, and/or as a ratio between the difference and the distance driven since the prior condition.

In some implementations, the wear model may be trained to determine the tire wear rate based on another attribute within the vehicle profile and/or the driver profile, such as the driving behavior and/or the driving location. In some implementations, the wear model may determine the tire wear rate based on one or more of an over-speeding event, a hard-acceleration event, a hard-braking event, a hard-cornering event, an average daily distance driven, an average daily speed, and/or another attribute indicative of how aggressive and/or how often the driver drives the vehicle. In some implementations, the wear model may determine the tire wear rate based on a local temperature, a climate condition, a road condition, a traffic condition, and/or another environmental attribute that can potentially affect the tire wear rate. In some implementations, the wear model may determine the tire wear rate based on an attribute within the vehicle profile that may not have already been factored into the wear rate (e.g., a vehicle weight, a drive type, a vehicle classification, a tire pressure, a tire rotation status, and/or the like).

In some implementations, the wear model may assign a different weight to each attribute based on the degree of influence the attribute has on the tire wear rate. For example, the wear model may assign greater weight to a hard-acceleration event, a hard-braking event, a hard-cornering event, an average daily distance driven, a local temperature, a climate condition, a road condition, a vehicle weight, a drive type, a tire pressure, and/or a tire rotation status. The wear model may assign less weight to, but still include in the calculation, an average daily speed, a traffic condition, a vehicle classification, and/or the like. In some implementations, the wear model may use different weighting factors for different vehicle profiles and/or driver profiles, and/or enable one or more of the weighting factors to be dependent on one or more of the other weighting factors. In some implementations, the wear model may vary the range of weighting that is assigned based on the desired level of granularity.

As another example, the wear model may be trained to estimate the wear rate of a brake pad. The wear model may determine a prior condition (e.g., prior brake pad thickness) of the brake pad based on an attribute within the vehicle profile (e.g., an attribute of the vehicle component derived from a service record and/or a maintenance record). For example, the prior condition may be determined based on when the brake pad was first installed (e.g., associated with a service date and a reported odometer reading of the vehicle). The wear model may determine a current condition (e.g., current brake pad thickness) of the brake pad based on an attribute within the vehicle profile (e.g., an attribute of the condition of the vehicle component derived from user-supplied information). The wear model may quantify the difference in brake pad thickness between the prior brake pad thickness and the current brake pad thickness, and estimate the brake pad wear rate as a ratio between the difference and the time elapsed since the prior condition, and/or as a ratio between the difference and the distance driven since the prior condition.

In some implementations, the wear model may determine the estimated brake pad wear rate based on an attribute of the driving behavior and/or the driving location. With respect to estimating brake pad wear rate, the wear model may assign greater weight to a hard-braking event, an average daily distance driven, a local temperature, a climate condition, a road condition, a traffic condition, and/or a vehicle weight. The wear model may assign less weight to a hard-acceleration event, a hard-cornering event, an average daily speed, a drive type, a vehicle classification, a tire pressure, and/or a tire rotation status. The wear model may use different weighting factors for different vehicle profiles and/or driver profiles, and/or vary the range of weighting factors that are assigned based on the desired level of granularity.

As a further example, the wear model may be trained to estimate the wear rate of a battery (e.g., the rate at which the output voltage of the battery decreases as a function of time and/or distance). The wear model may determine a prior condition (e.g., prior battery voltage) of the battery based on an attribute within the vehicle profile (e.g., an attribute of the vehicle component derived from a service record and/or a maintenance record). For example, the prior condition may be determined based on when the battery was first installed (e.g., associated with a service date and a reported odometer reading of the vehicle). The wear model may determine a current condition (e.g., current battery voltage) of the battery based on an attribute within the vehicle profile (e.g., an attribute of the condition of the vehicle component derived from user-supplied information and/or the vehicle telematics device). The wear model may calculate the voltage difference between the prior battery voltage and the current battery voltage, and estimate the battery wear rate based on correlations between the voltage difference, the time elapsed since the prior condition, and/or distance driven since the prior condition.

In some implementations, the wear model may be trained to determine the estimated battery wear rate based on an attribute of the driving behavior and/or the driving location. With respect to estimating battery wear rate, the wear model may assign greater weight to a local temperature, a climate condition, an average daily speed, an average daily distance driven, and/or a traffic condition. The wear model may assign lower weight to a hard-acceleration event, a road condition, and/or a vehicle classification, and assign even lower weight to a hard-braking event, a hard-cornering event, a drive type, a vehicle weight, a tire pressure, and/or a tire rotation status. The wear model may use different weighting factors for different vehicle profiles and/or driver profiles, and/or vary the range of weighting that is assigned based on the desired level of granularity.

In some implementations, the wear model may be trained to estimate a wear rate of another vehicle component that is commonly serviced and/or replaced. In some implementations, the wear model may be trained to estimate a wear rate for a brake rotor, a wheel bearing, an emission component, a shock absorber, and/or another commonly serviced vehicle component. In some implementations, the wear model may be trained to estimate a wear rate (e.g., rate of deterioration, contamination, and/or depletion) of a fluid, such as engine oil, transmission oil, coolant, brake fluid, and/or the like. In some implementations, the data analytics platform may train the wear model using a previous wear rate estimation that has been subsequently determined to be accurate or inaccurate in order to improve the wear model.

In some implementations, the wear model may implement a machine learning model that is trained with empirical data relating to a particular vehicle component (e.g., having a particular part brand, a part model, a part number, and/or the like). The empirical data may be collected by the data analytics platform from one or more vehicles that have the particular vehicle component installed (e.g., via user-supplied information, sensor data, and/or the like). For example, the data analytics platform may receive feedback from one or more drivers relating to the performance and/or the condition of the particular vehicle component over time. Additionally or alternatively, the data analytics platform may track the performance and/or the condition of the particular vehicle component based on the vehicle data. The machine learning model may be trained to receive the empirical data, and adjust the wear rate for the particular vehicle component to fit the empirical data. For example, the machine learning model may adjust an attribute used to estimate the wear rate, adjust a weighting factor applied to the attribute, incorporate an additional attribute, incorporate an additional weighting factor, and/or otherwise modify the wear model used for the particular vehicle component.

In some implementations, the data analytics platform trains and uses the wear model. In some implementations, another device (e.g., a server device, a cloud computing device, and/or the like) trains the wear model and provides the trained wear model for use by the data analytics platform. In some implementations, the data analytics platform trains the wear model for use by another device (e.g., a server device, a cloud computing device, and/or the like).

Figure 1D:
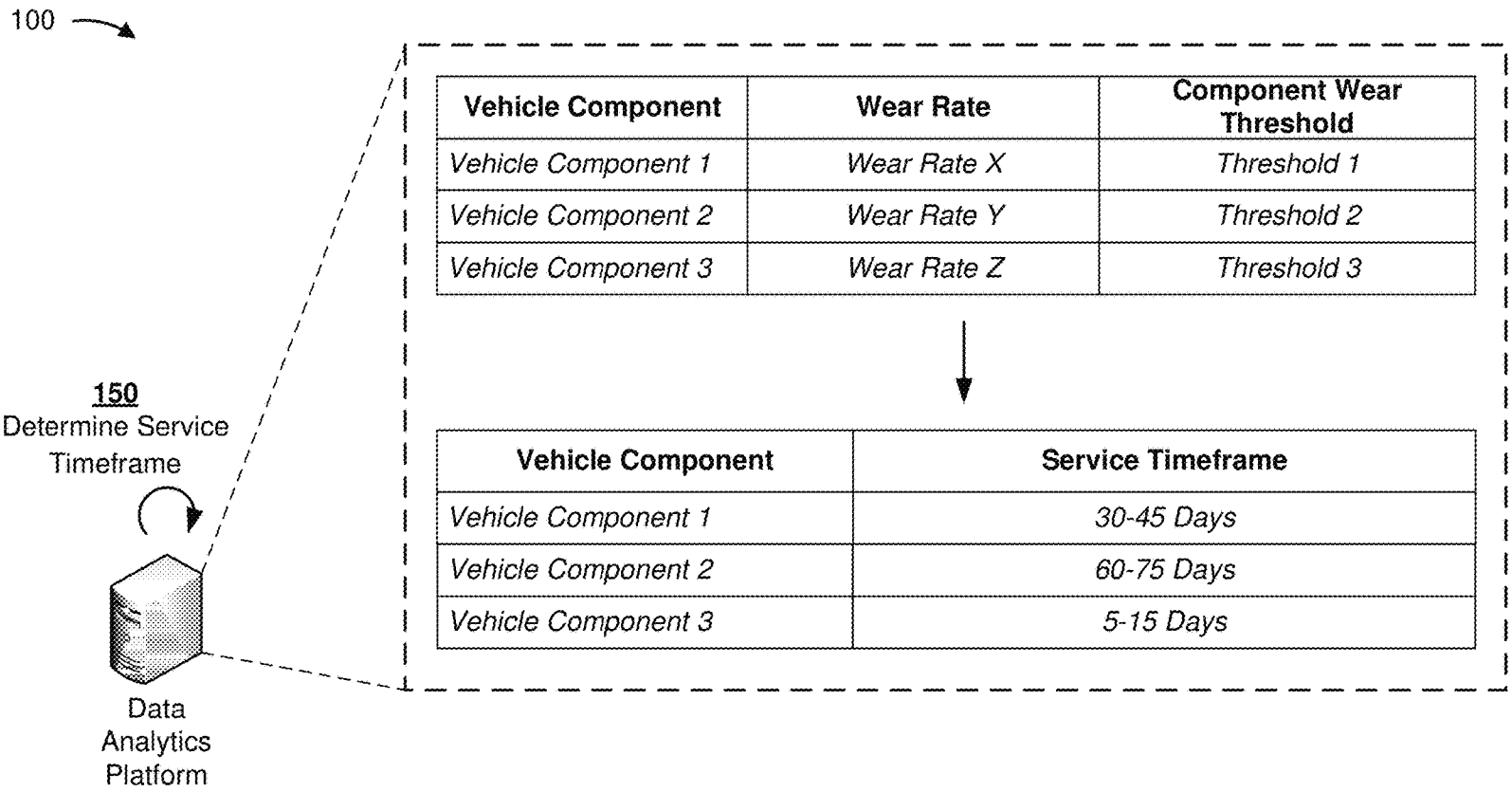

As shown in FIG. 1D, and by reference number 150, the data analytics platform may determine a service timeframe for the vehicle component, or the timeframe within which the vehicle component should be serviced. In some implementations, the data analytics platform may estimate the service timeframe based on the current condition of the vehicle component, the wear rate, and a wear threshold for the vehicle component. The current condition of the vehicle component may be determined based on an attribute within the vehicle profile (e.g., derived from vehicle data provided by the vehicle telematics device and/or the client device, and/or contextual information provided by the network storage device), as discussed above. The wear rate for the vehicle component may be determined by the wear model (e.g., based on one or more attributes of the vehicle profile and/or the driver profile), as discussed above. The wear threshold of the vehicle component may correspond to a minimum condition at which the vehicle component may be considered operational, safe, compliant with local regulations, and/or the like.

In some implementations, the data analytics platform may determine the wear threshold of a vehicle component (e.g., a tire, a brake pad, a battery, and/or another vehicle component). The wear threshold for a tire may be defined as a minimum tire tread depth, the wear threshold for a brake pad may be defined as a minimum brake pad thickness, and the wear threshold for a battery may be defined as a minimum unloaded battery voltage. The wear threshold may be derived from the vehicle data (e.g., user-supplied information), derived from contextual information (e.g., information specified by a manufacturer of the vehicle component, a regulatory agency, and/or the like), and/or preconfigured into the data analytics platform. In some implementations, the data analytics platform may determine the wear threshold according to a certain attribute within the vehicle profile and/or the driver profile.

In some implementations, the data analytics platform may estimate a remaining life of the vehicle component based on a difference between the current condition and the wear threshold (e.g., in terms of remaining tire tread depth, remaining brake pad thickness, remaining battery voltage, and/or the like). The data analytics platform may apply the wear rate (e.g., provided in terms of tire wear per day, brake pad wear per day, battery voltage drop per day, and/or the like) to the remaining life to convert the remaining life of the vehicle component into a unit of time (e.g., days of use remaining). Based on the time remaining on the vehicle component, the data analytics platform may determine the service timeframe for the vehicle component (e.g., in terms of a range of days, months, and/or years of use remaining). In some implementations, the range of the service timeframe may be defined based on a corresponding range of wear thresholds (e.g., between a first wear threshold indicative of when the vehicle component may become suboptimal, and a second wear threshold indicative of when the vehicle component may become inoperative).

Figure 1E:
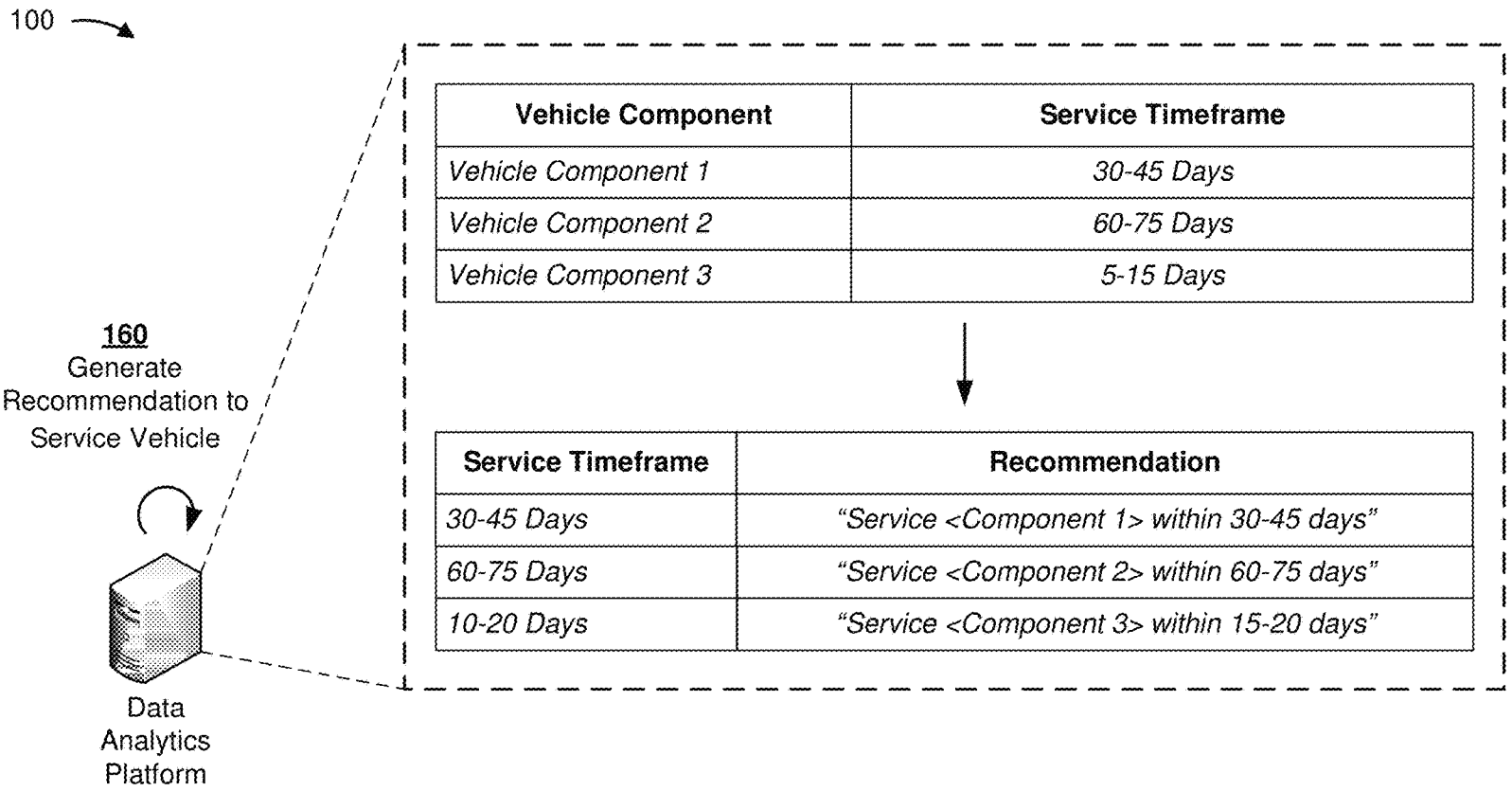

As shown in FIG. 1E, and by reference number 160, the data analytics platform may generate a recommendation for each vehicle component having an associated service timeframe. For example, the data analytics platform may generate a textual message directed to the driver recommending the driver to service the vehicle component within the service timeframe. In some implementations, the data analytics platform may generate the recommendation using an automated message and dynamic variables for the particular vehicle component and/or the associated service timeframe. In some implementations, the data analytics platform may generate the recommendation using another format (e.g., image format, audio format, video format, and/or the like). In some implementations, the data analytics platform may periodically (e.g., daily, weekly, monthly, and/or the like) and/or intermittently refresh or update the recommendation message (e.g., to account for a time elapsed, a change in the vehicle profile, a change in the driver profile, a change in the wear rate estimation, and/or a change in the service timeframe since the last recommendation).

Figure 1F:
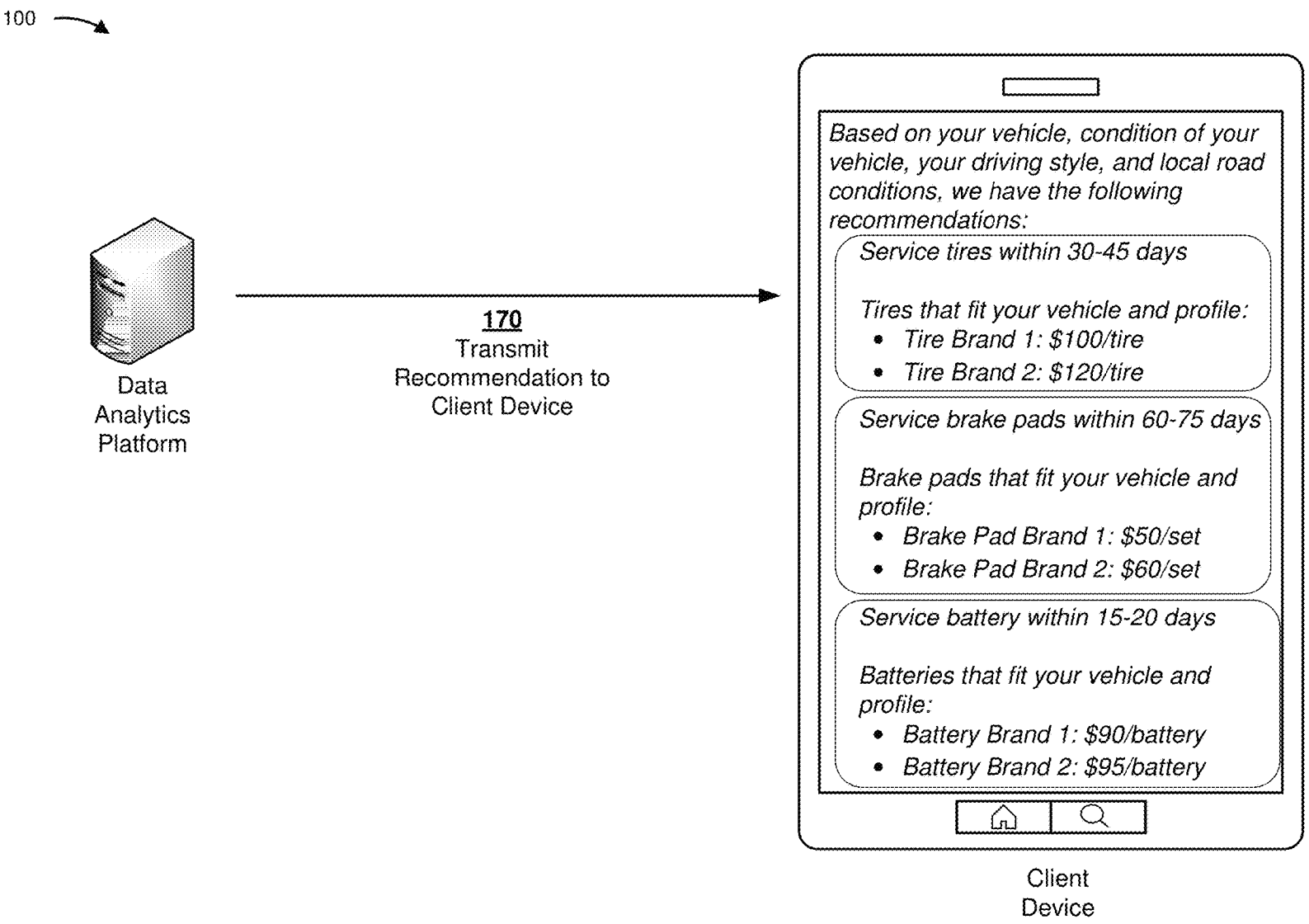

As shown in FIG. 1F, and by reference number 170, the data analytics platform may transmit the recommendation to the client device. The data analytics platform may transmit the recommendation via a user interface that is available on the client device. In some implementations, the recommendation may be transmitted via a client application that is operating on the client device and programmed to display the recommendation to the driver. In some implementations, the recommendation may be provided via a website hosted by the data analytics platform. The data analytics platform may then transmit a hyperlink to the client device that is configured to direct the client device to the website. In some implementations, the recommendation may be transmitted via a text or short message service (SMS) message, electronic mail, a notification, an alert, and/or the like. In some implementations, the recommendation may be transmitted using another format (e.g., as an image file, an audio file, an automated phone call, a video file, and/or the like).

In some implementations, the data analytics platform may transmit the recommendation to the client device in the form of a reminder and/or a calendar event. For example, the data analytics platform may automatically populate a calendar application on the client device with a calendar event regarding the recommendation on a date corresponding to the recommended service timeframe. In some implementations, the data analytics platform may transmit the recommendation to the vehicle to be displayed to the driver (e.g., via a dashboard display, a heads-up display, an infotainment system, a navigation system, and/or the like). In some implementations, the recommendation may be provided in an audio format (e.g., read to the driver via a voice command system of the vehicle and/or conveyed via another type of in-vehicle alert).

In some implementations, as shown for example in FIG. 1F, the data analytics platform may recommend a replacement component for the driver to purchase and install in place of the vehicle component needing service. In some implementations, the data analytics platform may identify a direct replacement component based on a specification of the particular vehicle component needing service (e.g., based on a part brand, a part model, a part number, and/or the like). In some implementations, the data analytics platform may identify a comparable replacement component based on a similarity to the specification of the vehicle component needing service (e.g., in terms of a size, a performance rating, a customer rating, and/or the like). In some implementations, the data analytics platform may identify a suggested replacement component that is different from the direct replacement component and the comparable replacement component, but more suited to the driver profile associated with the driver.

In some implementations, the data analytics platform may identify one or more of the direct replacement component, the comparable replacement component, and/or the suggested replacement component based on one or more of the vehicle profile, the driver profile, and/or any relevant contextual information not already incorporated into the vehicle profile and/or the driver profile. The data analytics platform may transmit information relating to one or more of the recommended replacement components to the client device. For example, the data analytics platform may include a cost for each recommended replacement component, a hyperlink enabling the driver to purchase the replacement component, an image of the replacement component, a customer rating of the replacement component, and/or the like.

In some implementations, the data analytics platform may facilitate the order and/or purchase of the replacement component for the driver. In some implementations, the data analytics platform may identify a vendor website that is frequently visited by the driver via the client device and that has the recommended replacement component in stock. The data analytics platform may connect to the vendor website and add the replacement component to a shopping cart and/or a shopping bag of the driver. In some implementations, the data analytics platform may automatically populate an order form and/or an order page of the vendor website using a credential of the driver stored within the client device. In some implementations, the data analytics platform may automatically submit the order using payment information stored on the client device. In some implementations, the data analytics platform may direct shipment of the order to an address of the driver or to a local service center, and provide a status notification to the driver when the order is delivered.

In some implementations, the data analytics platform may recommend a service center that is local to the driver and capable of servicing the vehicle component. For example, the data analytics platform may identify a service center based on the type of service needed by the driver and based on the location of the driver. The data analytics platform may determine the type of service needed based on the vehicle profile, determine the location of the driver based on the driver profile, and identify a local service center based on the contextual information. In some implementations, the data analytics platform may identify a local service center to recommend based on days and/or hours of operation, a customer review, an inventory of the replacement component, a labor cost, a service fee, and/or the like. The data analytics platform may transmit information relating to the recommended service center to the client device. In some implementations, the data analytics platform may include a hyperlink enabling the driver to schedule service with the recommended service center.

In some implementations, the data analytics platform may transmit the recommendation to the client device when the driver is determined to be in proximity to a service center capable of servicing the vehicle component. For example, using the location of the driver (e.g., via GPS data of the client device), and using a known location of a service center (e.g., via map data), the data analytics platform may determine when the driver is near to the service center, and recommend that the driver service the vehicle component at the service center. In some implementations, the data analytics platform may transmit the recommendation to the client device when the driver is determined to be in proximity to a vendor facility carrying the recommended replacement component.

In some implementations, the data analytics platform may determine when the vehicle component is serviced and/or replaced, and update the user account accordingly. For example, the data analytics platform may receive a confirmation from the driver via the client device (e.g., via user-supplied information) when the vehicle component is replaced. In some implementations, the data analytics platform may receive the confirmation from a service center (e.g., via a service record, a maintenance record, and/or the like). In some implementations, the confirmation may include information relating to the particular replacement component that was installed, a date of the installation, and/or an odometer reading of the vehicle at the time of the installation. Upon confirmation, the data analytics platform may update the vehicle profile, the driver profile, and/or the wear model associated with the driver, and/or reset the service timeframe for the vehicle component that was serviced.

In this way, the data analytics platform disclosed herein may enable a vehicle to operate more safely, efficiently, and with better fuel economy. By leveraging vehicle data that is specific to the vehicle, the vehicle component, and the driver of the vehicle, the data analytics platform is able to determine more accurate service timeframes for different vehicle components, and make more meaningful recommendations to the driver to service the vehicle. By enabling prompt service of worn vehicle components, the data analytics platform may reduce unnecessary wear to other vehicle components, and maintain the vehicle in optimal condition. Additionally, by leveraging vehicle data and wear models, the data analytics platform is able to conserve additional computational and network resources (e.g., processing resources, memory resources, power resources, communication resources, and/or the like) that may otherwise be used by the driver and/or service center personnel to manually research and troubleshoot the condition of the vehicle component.

As indicated above, FIGS. 1A-1F are provided as one or more examples. Other examples can differ from what is described with regard to FIGS. 1A-1F.

Figure 2:
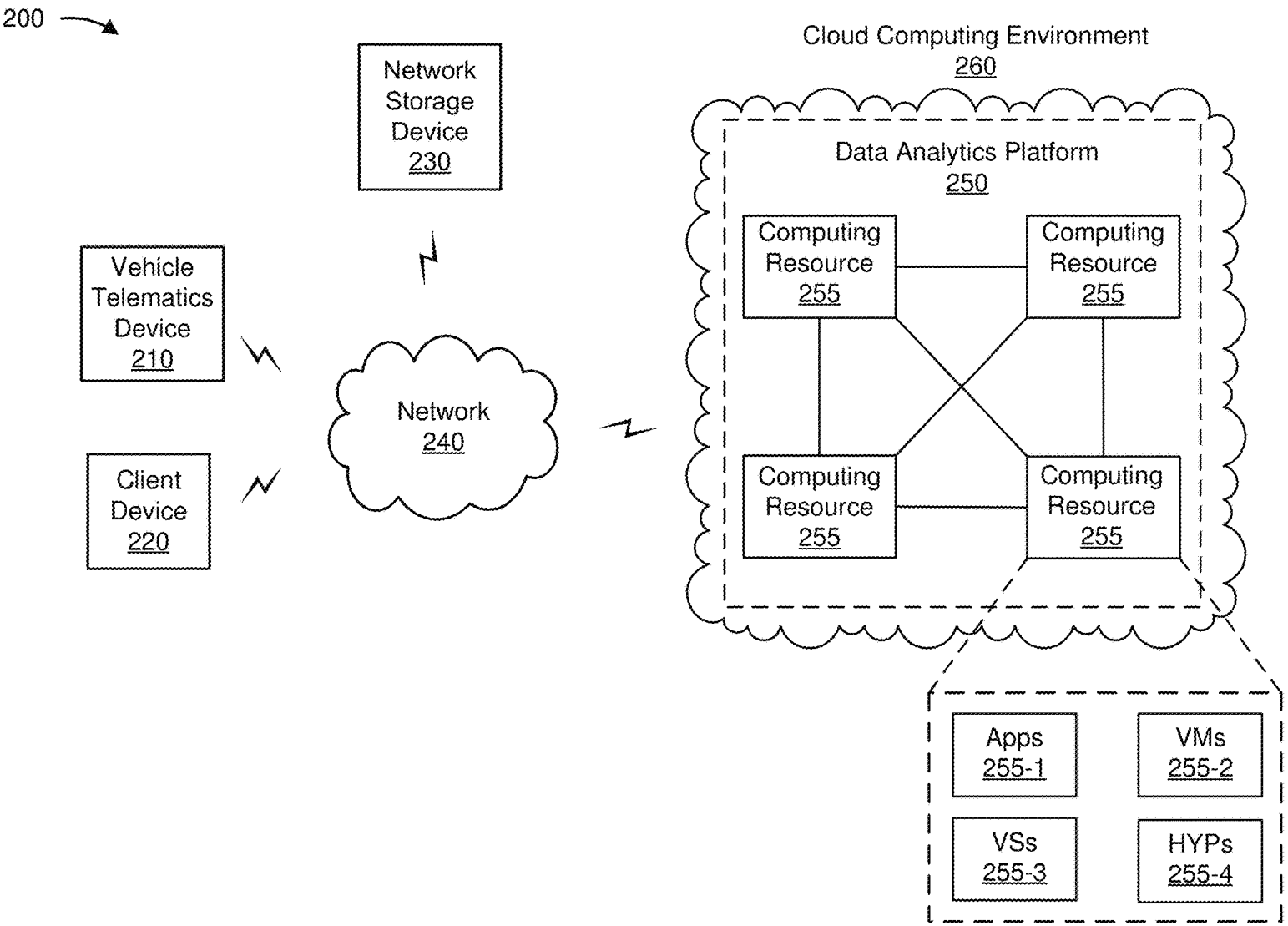
FIG. 2 is a diagram of an example environment in which systems and/or methods described herein may be implemented.

FIG. 2 is a diagram of an example environment 200 in which systems and/or methods, described herein, may be implemented. As shown in FIG. 2, environment 200 may include a vehicle telematics device 210, a client device 220, a network storage device 230, a network 240, a data analytics platform 250, a computing resource 255, and a cloud computing environment 260. The devices of environment 200 may interconnect via wired connections, wireless connections, or a combination of wired and wireless connections.

Vehicle telematics device 210 includes a device capable of receiving, generating, storing, processing, and/or providing vehicle data. For example, vehicle telematics device 210 may include a group of sensors associated with determining driving information, such as an accelerometer, a gyroscope, a GPS sensor, a magnetometer, a proximity sensor, a barometer, a camera, an audio sensor, a temperature sensor, and/or the like. In some implementations, vehicle telematics device 210 may be installed during manufacture of the vehicle. Alternatively, vehicle telematics device 210 may be installed post-manufacture as an aftermarket device. In some implementations, vehicle telematics device 210 may be coupled to and/or communicate with a communication interface of the vehicle (e.g., via an OBD port, and/or the like). In some implementations, vehicle telematics device 210 may communicate over wireless and/or wired connections with client device 220, network storage device 230, data analytics platform 250, and/or the like, via network 240.

Client device 220 includes one or more devices capable of receiving, generating, storing, processing, and/or providing information, such as vehicle data described herein. For example, client device 220 may include a communication and/or computing device, such as a mobile phone (e.g., a smart phone, a radiotelephone, and/or the like), a laptop computer, a tablet computer, a handheld computer, a desktop computer, a gaming device, a wearable communication device (e.g., a smart wristwatch, a pair of smart eyeglasses, and/or the like), or a similar type of device. In some implementations, client device 220 may receive information from and/or transmit information to vehicle telematics device 210, network storage device 230, data analytics platform 250, and/or the like.

Network storage device 230 includes one or more devices capable of storing, processing, and/or routing information. Network storage device 230 may include, for example, a server device, a device that stores a database, a device in a cloud computing environment or a data center, a device in a core network of a network operator, a network controller, and/or the like. In some implementations, network storage device 230 may include a communication interface that allows network storage device 230 to receive information from and/or transmit information to other devices in environment 200, such as vehicle telematics device 210, client device 220, data analytics platform 250, and/or the like.

Network 240 includes one or more wired and/or wireless networks. For example, network 240 may include a cellular network (e.g., a long-term evolution (LTE) network, a code division multiple access (CDMA) network, a 3G network, a 4G network, a 5G network, another type of next generation network, and/or the like), a public land mobile network (PLMN), a local area network (LAN), a wide area network (WAN), a metropolitan area network (MAN), a telephone network (e.g., the Public Switched Telephone Network (PSTN)), a private network, an ad hoc network, an intranet, the Internet, a fiber optic-based network, a cloud computing network, or the like, and/or a combination of these or other types of networks.

Data analytics platform 250 includes one or more devices capable of determining a wear rate of a vehicle component based on vehicle data, determine a service timeframe for servicing the vehicle component, and generate a recommendation to service the vehicle component within the service timeframe. In some implementations, data analytics platform 250 may be designed to be modular such that certain software components may be swapped in or out depending on a particular need. As such, data analytics platform 250 may be easily and/or quickly reconfigured for different uses. In some implementations, data analytics platform 250 may receive information from and/or transmit information to vehicle telematics device 210, client device 220, network storage device 230, and/or the like.

In some implementations, data analytics platform 250 may be hosted in cloud computing environment 260. Notably, while implementations described herein describe data analytics platform 250 as being hosted in cloud computing environment 260, in some implementations, data analytics platform 250 may be non-cloud-based or may be partially cloud-based.

Cloud computing environment 260 includes an environment that delivers computing as a service, whereby shared resources, services, etc. may be provided to vehicle telematics device 210, client device 220, network storage device 230, and/or the like. Cloud computing environment 260 may provide computation, software, data access, storage, and/or other services that do not require end-user knowledge of a physical location and configuration of a system and/or a device that delivers the services. As shown, cloud computing environment 260 may include data analytics platform 250 and computing resource 255.

Computing resource 255 includes one or more personal computers, workstation computers, server devices, or another type of computation and/or communication device. In some implementations, computing resource 255 may host data analytics platform 250. The cloud resources may include compute instances executing in computing resource 255, storage devices provided in computing resource 255, data transfer devices provided by computing resource 255, etc. In some implementations, computing resource 255 may communicate with other computing resources 255 via wired connections, wireless connections, or a combination of wired and wireless connections.

As further shown in FIG. 2, computing resource 255 may include a group of cloud resources, such as one or more applications ("Apps") 255-1, one or more virtual machines ("VMs") 255-2, virtualized storage ("VSs") 255-3, one or more hypervisors ("HYPs") 255-4, or the like.

Application 255-1 includes one or more software applications that may be provided to or accessed by client device 220. Application 255-1 may eliminate a need to install and execute the software applications on client device 220. For example, application 255-1 may include software associated with data analytics platform 250 and/or other software capable of being provided via cloud computing environment 260. In some implementations, one application 255-1 may send/receive information to/from one or more other applications 255-1, via virtual machine 255-2.

Virtual machine 255-2 includes a software implementation of a machine (e.g., a computer) that executes programs like a physical machine. Virtual machine 255-2 may be either a system virtual machine or a process virtual machine, depending upon use and degree of correspondence to any real machine by virtual machine 255-2. A system virtual machine may provide a complete system platform that supports execution of a complete operating system ("OS"). A process virtual machine may execute a single program and may support a single process. In some implementations, virtual machine 255-2 may execute on behalf of a user (e.g., client device 220), and may manage infrastructure of cloud computing environment 260, such as data management, synchronization, or long-duration data transfers.

Virtualized storage 255-3 includes one or more storage systems and/or one or more devices that use virtualization techniques within the storage systems or devices of computing resource 255. In some implementations, within the context of a storage system, types of virtualizations may include block virtualization and file virtualization. Block virtualization may refer to abstraction (or separation) of logical storage from physical storage so that the storage system may be accessed without regard to physical storage or heterogeneous structure. The separation may permit administrators of the storage system flexibility in how the administrators manage storage for end users. File virtualization may eliminate dependencies between data accessed at a file level and a location where files are physically stored. This may enable optimization of storage use, server consolidation, and/or performance of non-disruptive file migrations.

Hypervisor 255-4 provides hardware virtualization techniques that allow multiple operating systems (e.g., "guest operating systems") to execute concurrently on a host computer, such as computing resource 255. Hypervisor 255-4 may present a virtual operating platform to the guest operating systems and may manage the execution of the guest operating systems. Multiple instances of a variety of operating systems may share virtualized hardware resources.

The number and arrangement of devices and networks shown in FIG. 2 are provided as one or more examples. In practice, there may be additional devices and/or networks, fewer devices and/or networks, different devices and/or networks, or differently arranged devices and/or networks than those shown in FIG. 2. Furthermore, two or more devices shown in FIG. 2 may be implemented within a single device, or a single device shown in FIG. 2 may be implemented as multiple, distributed devices. Additionally or alternatively, a set of devices (e.g., one or more devices) of environment 200 may perform one or more functions described as being performed by another set of devices of environment 200.

Figure 3:
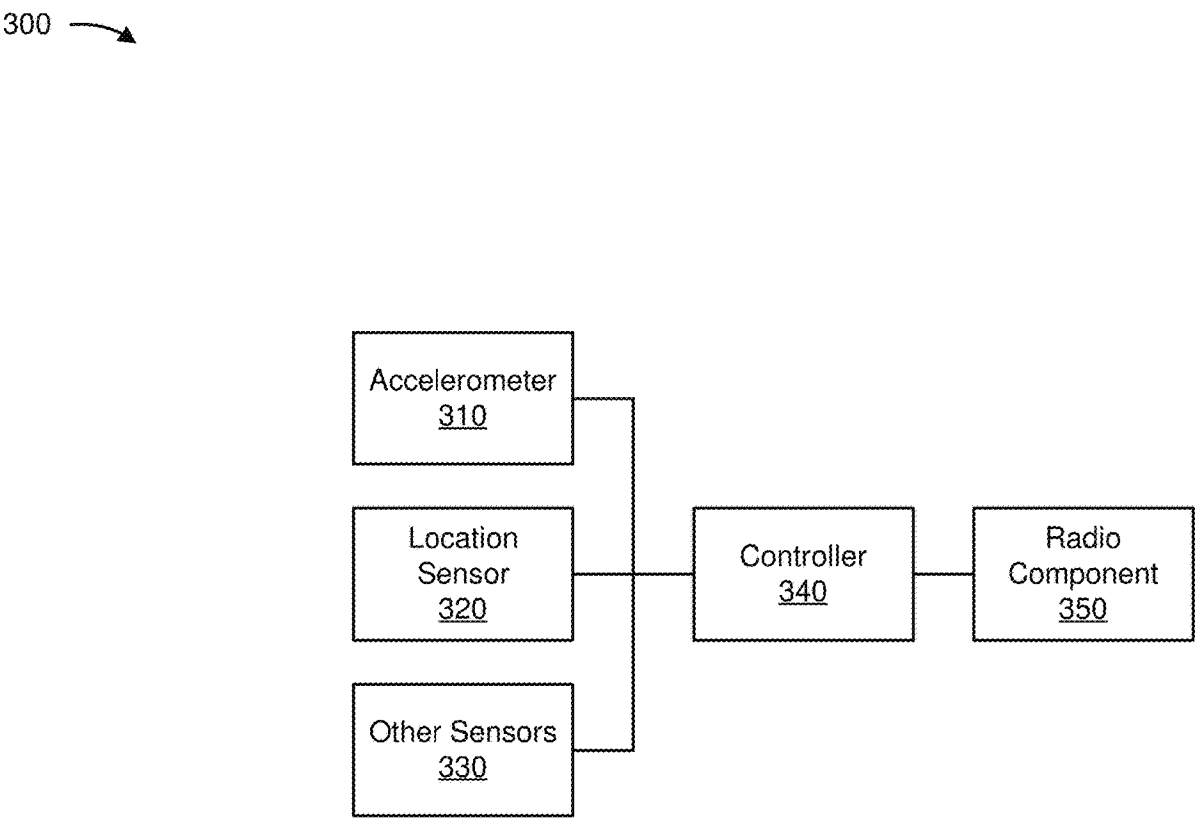
FIG. 3 is a diagram of example components of one or more devices of FIG. 2.

FIG. 3 is a diagram of example components of a device 300. Device 300 may correspond to vehicle telematics device 210 and/or client device 220. Additionally or alternatively, each of vehicle telematics device 210 and/or client device 220 may include one or more devices 300 and/or one or more components of device 300. In some implementations, vehicle telematics device 210 and/or client device 220 may include one or more other devices, such as a device shown in FIG. 4. As shown in FIG. 3, device 300 may include an accelerometer 310, a location sensor 320, other sensors 330, a controller 340, and/or a radio component 350.

Accelerometer 310 includes an accelerometer that is capable of measuring an acceleration, associated with a vehicle, and outputting information associated with the measured acceleration. For example, accelerometer 310 may measure the acceleration, and may output the acceleration as three acceleration values, each corresponding to an acceleration value associated with one of three orthogonal axes (e.g., an X-axis, a Y-axis, a Z-axis). In some implementations, the acceleration values, measured by accelerometer 310, may be provided to controller 340 for processing.

Location sensor 320 includes a sensor designed to determine a geographic location (e.g., a latitude, a longitude, and/or the like) of a device (e.g., vehicle telematics device 210 and/or client device 220). For example, location sensor 320 may include a GPS sensor, a GLONASS-based sensor, or another type of sensor used to determine a location. In some implementations, the location data, determined by location sensor 320, may be provided to controller 340 for processing.

Other sensors 330 may include other environmental sensors capable of measuring information associated with determining driving information. For example, other sensors 330 may include a barometric pressure sensor, a gyroscope, a magnetometer, a proximity sensor, a temperature sensor, a light sensor (e.g., a photodiode sensor), an altimeter sensor, an infrared sensor, an audio sensor, or a biomarker sensor (e.g., a fingerprint sensor), or another type of sensor (e.g. a spectrometer, a heart rate sensor, a variable heart rate sensor, a blood oxygen sensor, a glucose sensor, a blood alcohol sensor, a temperature sensor, a humidity sensor, and/or the like). In some implementations, the sensor information, determined by other sensors 330, may be provided to controller 340 for processing.

Controller 340 includes a processor used to control vehicle telematics device 210 and/or client device 220. In some implementations, controller 340 may include and/or be capable of communicating with a memory component that stores instructions for execution by controller 340. Additionally or alternatively, controller 340 may determine, detect, store, and/or transmit driving information associated with a driver (e.g., based on sensor information received by controller 340).

Radio component 350 includes a component to manage a radio interface, such as a radio interface to wirelessly connect to network 240. For example, radio component 350 may provide an interface to a wireless cellular network (e.g., a ZigBee network, a Bluetooth network, a Wi-Fi network, and/or the like) associated with network 240. In some implementations, radio component 350 may include one or more antennae and corresponding transceiver circuitry.

The number and arrangement of components shown in FIG. 3 are provided as an example. In practice, device 300 may include additional components, fewer components, different components, or differently arranged components than those shown in FIG. 3. Additionally or alternatively, a set of components (e.g., one or more components) of device 300 may perform one or more functions described as being performed by another set of components of device 300.

Figure 4:
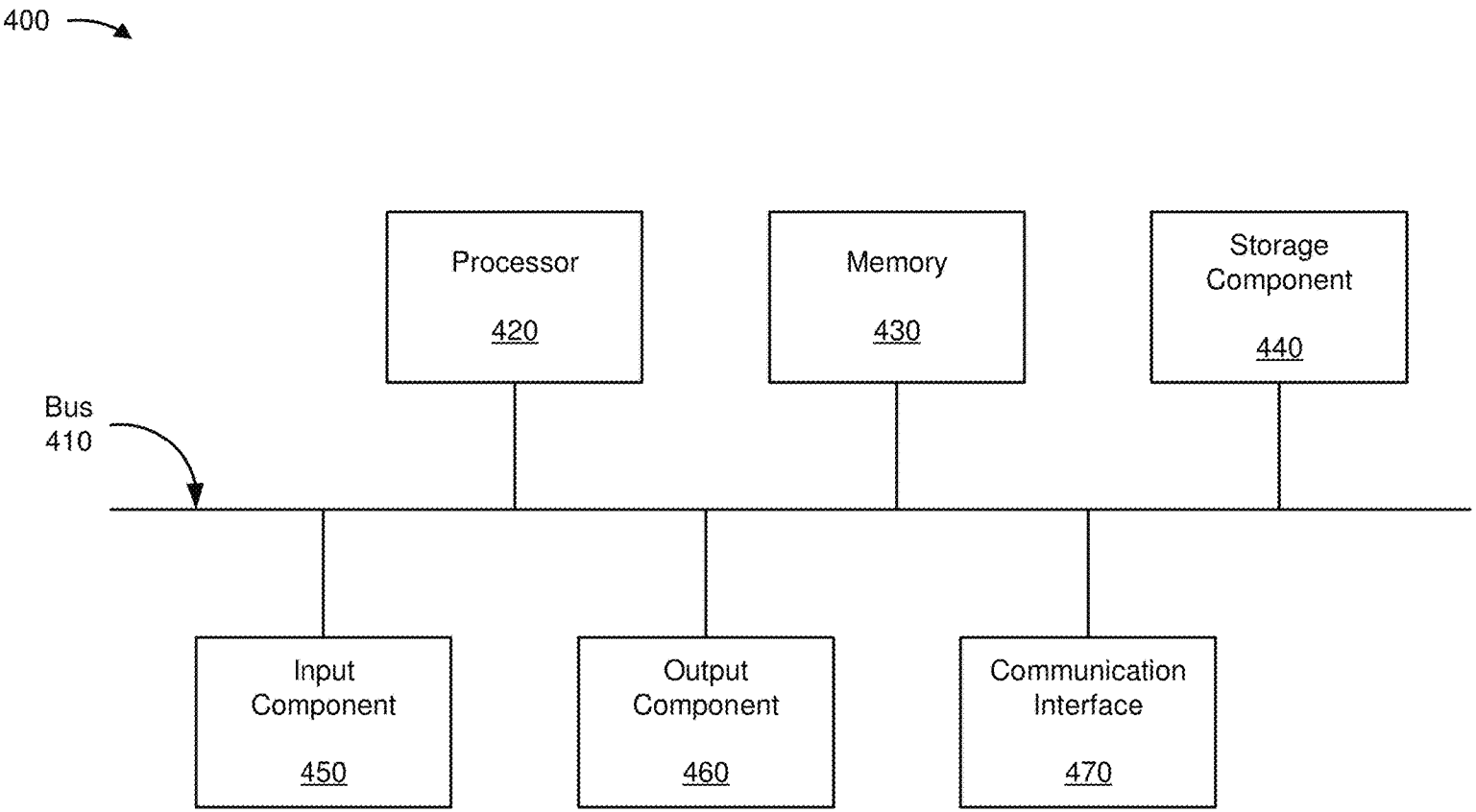
FIG. 4 is a diagram of example components of one or more devices of FIG. 2.

FIG. 4 is a diagram of example components of a device 400. Device 400 may correspond vehicle telematics device 210, client device 220, network storage device 230, data analytics platform 250, and/or computing resource 255. In some implementations, vehicle telematics device 210, client device 220, network storage device 230, data analytics platform 250, and/or computing resource 255 may include one or more devices 400 and/or one or more components of device 400. As shown in FIG. 4, device 400 may include a bus 410, a processor 420, a memory 430, a storage component 440, an input component 450, an output component 460, and a communication interface 470.

Bus 410 includes a component that permits communication among multiple components of device 400. Processor 420 is implemented in hardware, firmware, and/or a combination of hardware and software. Processor 420 is a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. In some implementations, processor 420 includes one or more processors capable of being programmed to perform a function. Memory 430 includes a random access memory (RAM), a read only memory (ROM), and/or another type of dynamic or static storage device (e.g., a flash memory, a magnetic memory, and/or an optical memory) that stores information and/or instructions for use by processor 420.

Storage component 440 stores information and/or software related to the operation and use of device 400. For example, storage component 440 may include a hard disk (e.g., a magnetic disk, an optical disk, and/or a magneto-optic disk), a solid state drive (SSD), a compact disc (CD), a digital versatile disc (DVD), a floppy disk, a cartridge, a magnetic tape, and/or another type of non-transitory computer-readable medium, along with a corresponding drive.

Input component 450 includes a component that permits device 400 to receive information, such as via user input (e.g., a touch screen display, a keyboard, a keypad, a mouse, a button, a switch, and/or a microphone). Additionally or alternatively, input component 450 may include a component for determining location (e.g., a global positioning system (GPS) component) and/or a sensor (e.g., an accelerometer, a gyroscope, an actuator, another type of positional or environmental sensor, and/or the like). Output component 460 includes a component that provides output information from device 400 (via, e.g., a display, a speaker, a haptic feedback component, an audio or visual indicator, and/or the like).

Communication interface 470 includes a transceiver-like component (e.g., a transceiver, a separate receiver, a separate transmitter, and/or the like) that enables device 400 to communicate with other devices, such as via a wired connection, a wireless connection, or a combination of wired and wireless connections. Communication interface 470 may permit device 400 to receive information from another device and/or provide information to another device. For example, communication interface 470 may include an Ethernet interface, an optical interface, a coaxial interface, an infrared interface, a radio frequency (RF) interface, a universal serial bus (USB) interface, a wireless local area network interface, a cellular network interface, and/or the like.

Device 400 may perform one or more processes described herein. Device 400 may perform these processes based on processor 420 executing software instructions stored by a non-transitory computer-readable medium, such as memory 430 and/or storage component 440. As used herein, the term "computer-readable medium" refers to a non-transitory memory device. A memory device includes memory space within a single physical storage device or memory space spread across multiple physical storage devices.

Software instructions may be read into memory 430 and/or storage component 440 from another computer-readable medium or from another device via communication interface 470. When executed, software instructions stored in memory 430 and/or storage component 440 may cause processor 420 to perform one or more processes described herein. Additionally or alternatively, hardware circuitry may be used in place of or in combination with software instructions to perform one or more processes described herein. Thus, implementations described herein are not limited to any specific combination of hardware circuitry and software.

The number and arrangement of components shown in FIG. 4 are provided as an example. In practice, device 400 may include additional components, fewer components, different components, or differently arranged components than those shown in FIG. 4. Additionally or alternatively, a set of components (e.g., one or more components) of device 400 may perform one or more functions described as being performed by another set of components of device 400.

Figure 5:
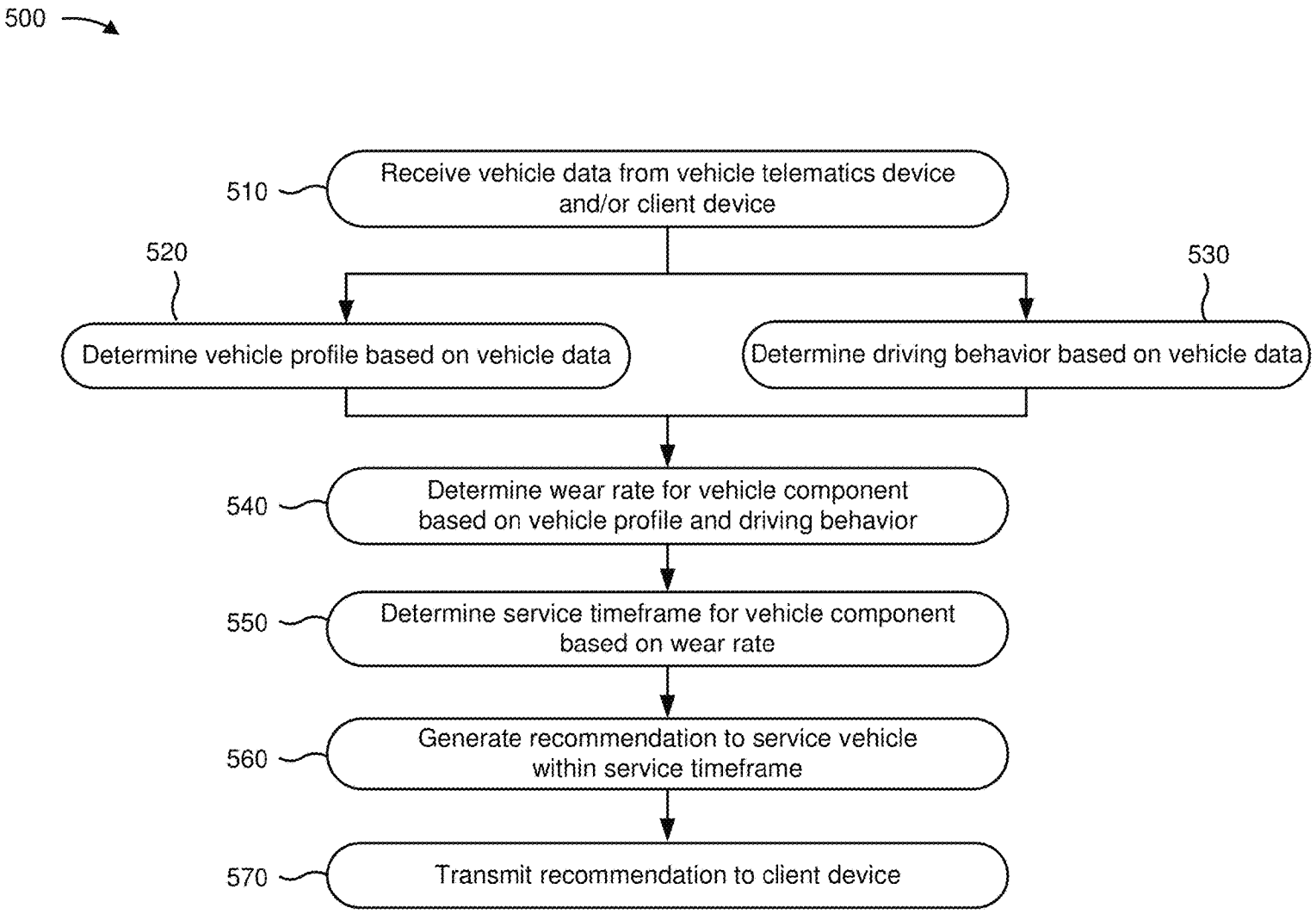
FIG. 5 is a flow chart of an example process for determining a service timeframe for a vehicle component.

FIG. 5 is a flow chart of an example process 500 for determining a service timeframe for a vehicle component. In some implementations, one or more process blocks of FIG. 5 may be performed by a data analytics platform (e.g., data analytics platform 250). In some implementations, one or more process blocks of FIG. 5 may be performed by another device or a group of devices separate from or including data analytics platform, such as a vehicle telematics device (e.g., vehicle telematics device 210), a client device (e.g., client device 220), or a network storage device (e.g., network storage device 230).

As shown in FIG. 5, process 500 may include receiving vehicle data from vehicle telematics device and/or client device (block 510). For example, the data analytics platform (e.g., using a computing resource 255, a processor 420, a memory 430, a storage component 440, an input component 450, and a communication interface 470, and/or the like) may receive vehicle data from vehicle telematics device and/or client device, as described above.

As further shown in FIG. 5, process 500 may include determining a vehicle profile based on vehicle data (block 520). For example, the data analytics platform (e.g., using a computing resource 255, a processor 420, a memory 430, a storage component 440, an input component 450, and a communication interface 470, and/or the like) may determine a vehicle profile based on vehicle data, as described above.

As further shown in FIG. 5, process 500 may include determining a driver profile based on vehicle data (block 530). For example, the data analytics platform (e.g., using a computing resource 255, a processor 420, a memory 430, a storage component 440, an input component 450, and a communication interface 470, and/or the like) may determine a driver profile based on vehicle data, as described above.

As further shown in FIG. 5, process 500 may include determining a wear rate for vehicle component based on vehicle profile and driver profile (block 540). For example, the data analytics platform (e.g., using a computing resource 255, a processor 420, a memory 430, a storage component 440, an input component 450, and a communication interface 470, and/or the like) may determine a wear rate for vehicle component based on vehicle profile and driver profile, as described above.

As further shown in FIG. 5, process 500 may include determining a service timeframe for vehicle component based on wear rate (block 550). For example, the data analytics platform (e.g., using a computing resource 255, a processor 420, a memory 430, a storage component 440, an input component 450, and a communication interface 470, and/or the like) may determine a service timeframe for vehicle component based on wear rate, as described above.

As further shown in FIG. 5, process 500 may include generating a recommendation to service vehicle within service timeframe (block 560). For example, the data analytics platform (e.g., using a computing resource 255, a processor 420, a memory 430, a storage component 440, an input component 450, and a communication interface 470, and/or the like) may generate a recommendation to service vehicle within service timeframe, as described above.

As further shown in FIG. 5, process 500 may include transmitting the recommendation to client device (block 570). For example, the data analytics platform (e.g., using a computing resource 255, a processor 420, a memory 430, a storage component 440, an output component 460, and a communication interface 470, and/or the like) may transmit the recommendation to client device, as described above.

Process 500 may include additional implementations, such as any single implementation or any combination of implementations described below and/or in connection with one or more other processes described elsewhere herein.

In some implementations, when determining the vehicle profile, the data analytics platform may receive an image of the vehicle component in proximity to a reference object having a particular dimension, and determine, using a component condition model, the condition of the vehicle component. In some implementations, the component condition model may be trained to estimate the condition of the vehicle component based on an image-based analysis of the vehicle component and the reference object.

In some implementations, when determining the driver profile, the data analytics platform may determine a number of hard-braking events within a particular time interval of the vehicle data, and determine the driving behavior based on the number of hard-braking events.

In some implementations, when determining the wear rate, the data analytics platform may determine, using the wear model, the wear rate for the vehicle component based on the driving behavior. In some implementations, the driving behavior may be determined based on a number of hard-braking and/or hard-acceleration events within a particular time interval of the vehicle data. In some implementations, the wear model may be trained to estimate the wear rate for the vehicle component based on the driving behavior.

In some implementations, when determining the wear rate for a brake pad, the data analytics platform may determine, using the wear model, a brake pad wear rate for the brake pad based on the vehicle profile and the driver profile. In some implementations, when determining the service timeframe, the data analytics platform may determine a brake pad service timeframe based on brake pad wear rate and a brake pad wear threshold.

In some implementations, when determining the service timeframe, the data analytics platform may determine the service timeframe based on the condition of the vehicle component, the wear rate for the vehicle component, and the threshold associated with the wear of the vehicle component.

In some implementations, the data analytics platform may further identify a replacement component that is recommended for the vehicle based on the vehicle profile and the driver profile, and transmit information relating to the replacement component to the client device.

In some implementations, when determining the driver profile, the data analytics platform may determine the driving location and a climate condition associated with the driving location. In some implementations, the vehicle data may include global positioning system (GPS) data, and the driving location may be determined based on the GPS data.

In some implementations, when determining the wear rate for the vehicle component, the data analytics platform may determine, using the wear model, the wear rate for the vehicle component based on the driving location and a climate condition associated with the driving location. In some implementations, the driving location and the climate condition may be determined based on global positioning system (GPS) data within the vehicle data, and the wear model may be trained to estimate the wear rate for the vehicle component based on the driving location and the climate condition.

In some implementations, when determining the wear rate for the vehicle component, the data analytics platform may determine, using the wear model, the wear rate for the vehicle component based on the driving behavior. In some implementations, the driving behavior may be determined based on an average daily distance driven corresponding to a particular time interval of the vehicle data, and the wear model may be trained to estimate the wear rate for the vehicle component based on the driving behavior.

In some implementations, when determining the wear rate for a battery of the vehicle, the data analytics platform may determine, using the wear model, a battery wear rate for the battery based on the vehicle profile and the driver profile. In some implementations, when determining the service timeframe, the data analytics platform may determine a battery service timeframe for the battery based on the battery wear rate and a battery wear threshold.

In some implementations, the data analytics platform may further identify a recommended service center based on the vehicle profile, the driver profile, and the vehicle component, and transmit information relating to the recommended service center to the client device.

In some implementations, when determining the vehicle profile, the data analytics platform may determine a vehicle make, a vehicle model, a vehicle model year, and the condition of the vehicle component based on at least one of the vehicle data or the image data.

In some implementations, when determining the driver profile, the data analytics platform may determine a number of hard-acceleration events within a particular time interval of the vehicle data, and determine the driving behavior based on the number of hard-acceleration events.

In some implementations, when determining the wear rate for the vehicle component, the data analytics platform may determine, using the wear model, the wear rate for the vehicle component based on the driving behavior. In some implementations, the driving behavior may be determined based on a number of hard-acceleration events within a particular time interval of the vehicle data, and the wear model may be trained to estimate the wear rate for the vehicle component based on the driving behavior.

In some implementations, when determining the wear rate for a tire of the vehicle, the data analytics platform may determine, using the wear model, a tire wear rate for the tire based on the vehicle profile and the driver profile. In some implementations, when determining the service timeframe, the data analytics platform may determine a tire service timeframe for the tire based on the tire wear rate and a tire wear threshold.

Although FIG. 5 shows example blocks of process 500, in some implementations, process 500 may include additional blocks, fewer blocks, different blocks, or differently arranged blocks than those depicted in FIG. 5. Additionally or alternatively, two or more of the blocks of process 500 may be performed in parallel.

The foregoing disclosure provides illustration and description, but is not intended to be exhaustive or to limit the implementations to the precise form disclosed. Modifications and variations may be made in light of the above disclosure or may be acquired from practice of the implementations.

As used herein, the term "component" is intended to be broadly construed as hardware, firmware, or a combination of hardware and software.

Some implementations are described herein in connection with thresholds. As used herein, satisfying a threshold may, depending on the context, refer to a value being greater than the threshold, more than the threshold, higher than the threshold, greater than or equal to the threshold, less than the threshold, fewer than the threshold, lower than the threshold, less than or equal to the threshold, equal to the threshold, etc., depending on the context.

Certain user interfaces have been described herein and/or shown in the figures. A user interface may include a graphical user interface, a non-graphical user interface, a text-based user interface, and/or the like. A user interface may provide information for display. In some implementations, a user may interact with the information, such as by providing input via an input component of a device that provides the user interface for display. In some implementations, a user interface may be configurable by a device and/or a user (e.g., a user may change the size of the user interface, information provided via the user interface, a position of information provided via the user interface, and/or the like). Additionally or alternatively, a user interface may be pre-configured to a standard configuration, a specific configuration based on a type of device on which the user interface is displayed, and/or a set of configurations based on capabilities and/or specifications associated with a device on which the user interface is displayed.

To the extent the aforementioned implementations collect, store, or employ personal information of individuals, it should be understood that such information shall be used in accordance with all applicable laws concerning protection of personal information. Additionally, the collection, storage, and use of such information can be subject to consent of the individual to such activity, for example, through well known "opt-in" or "opt-out" processes as can be appropriate for the situation and type of information. Storage and use of personal information can be in an appropriately secure manner reflective of the type of information, for example, through various encryption and anonymization techniques for particularly sensitive information.

It will be apparent that systems and/or methods described herein may be implemented in different forms of hardware, firmware, and/or a combination of hardware and software. The actual specialized control hardware or software code used to implement these systems and/or methods is not limiting of the implementations. Thus, the operation and behavior of the systems and/or methods are described herein without reference to specific software code—it being understood that software and hardware can be used to implement the systems and/or methods based on the description herein.

Even though particular combinations of features are recited in the claims and/or disclosed in the specification, these combinations are not intended to limit the disclosure of various implementations. In fact, many of these features may be combined in ways not specifically recited in the claims and/or disclosed in the specification. Although each dependent claim listed below may directly depend on only one claim, the disclosure of various implementations includes each dependent claim in combination with every other claim in the claim set.

No element, act, or instruction used herein should be construed as critical or essential unless explicitly described as such. Also, as used herein, the articles "a" and "an" are intended to include one or more items, and may be used interchangeably with "one or more." Further, as used herein, the article "the" is intended to include one or more items referenced in connection with the article "the" and may be used interchangeably with "the one or more." Furthermore, as used herein, the term "set" is intended to include one or more items (e.g., related items, unrelated items, a combination of related and unrelated items, etc.), and may be used interchangeably with "one or more." Where only one item is intended, the phrase "only one" or similar language is used. Also, as used herein, the terms "has," "have," "having," or the like are intended to be open-ended terms. Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A method, comprising:

determining, by a device and based on receiving vehicle data associated with a particular driver, a driver profile including information regarding a driving behavior indicative of the particular driver;

determining, by the device and based on a wear model, associated with a vehicle component of a particular vehicle, and the driver profile, a wear rate for the vehicle component;

determining, based on the wear rate for the vehicle component and the driver profile, a service timeframe for the vehicle component;

generating, based on the service timeframe for the vehicle component, a service recommendation for the vehicle component; and transmitting the service recommendation for the vehicle component to a user device.

2. The method of claim 1, further comprising:

determining a vehicle profile associated with the particular vehicle, wherein determining the wear rate for the vehicle component is based on determining the vehicle profile.

3. The method of claim 2, wherein the vehicle profile includes information regarding a condition of the vehicle component.

4. The method of claim 1, wherein the driver profile stores information regarding a driving location associated with the particular driver.

5. The method of claim 1, wherein determining the wear rate for the vehicle component comprises:

identifying, based on the wear model and the driver profile, a prior condition of the vehicle component;

identifying, based on the wear model and the driver profile, a current condition of the vehicle component; and determining, based on the prior condition of the vehicle component and the current condition of the vehicle component, the wear rate for the vehicle component.

6. The method of claim 1, wherein the determining the wear rate for the vehicle component comprises:

identifying, based on accessing the driver profile, one or more attributes associated with the driver profile;

determining, based on identifying the one or more attributes, a weighting factor for each of the one or more attributes; and determining, based on the weighting factor, for each of the one or more attributes, and the wear model, the wear rate for the vehicle component.

7. The method of claim 6, wherein the weighting factor, for each of the one or more attributes, is based on a degree of influence that a respective attribute, of the one or more attributes, has on the vehicle component.

8. The method of claim 1, wherein the wear model implements a machine learning model trained with empirical data relating to the vehicle component.

9. The method of claim 8, wherein the empirical data is received from one or more other vehicles having the vehicle component.

10. A device, comprising:

one or more memories; and one or more processors, coupled to the one or more memories, configured to:

determine, based on receiving vehicle data associated with a particular driver, a driver profile including information regarding a driving behavior indicative of the Particular driver;

determine, based on a wear model, associated with a vehicle component of a particular vehicle, and the driver profile, a wear rate for the vehicle component;

determine, based on the wear rate for the vehicle component and the driver profile, a service timeframe for the vehicle component;

generate, based on the service timeframe for the vehicle component, a service recommendation for the vehicle component; and transmit the service recommendation for the vehicle component to a user device.

11. The device of claim 10, wherein the one or more processors, to determine the wear rate for the vehicle component, are configured to:

identify, based on the wear model and the driver profile, a prior condition of the vehicle component;

identify, based on the wear model and the driver profile, a current condition of the vehicle component; and determine, based on the prior condition and the current condition of the vehicle component, the wear rate for the vehicle component.

12. The device of claim 10, wherein the one or more processors, to determine the wear rate for the vehicle component, are configured to:

identify, based on accessing the driver profile, one or more attributes associated with the driver profile;

determine, based on identifying the one or more attributes, a weighting factor for each of the one or more attributes; and determine, based on the weighting factor, for each of the one or more attributes, and the wear model, the wear rate of the vehicle component.

13. The device of claim 12, wherein the weighting factor, for at least one attribute of the one or more attributes, is based on a degree of influence that the at least one attribute has on the vehicle component.

14. The device of claim 10, wherein the wear model implements a machine learning model trained with empirical data from a plurality of different vehicles, including the particular vehicle, having the vehicle component.

15. A non-transitory computer-readable medium storing a set of instructions, the set of instructions comprising:

one or more instructions that, when executed by one or more processors of a device, cause the device to:

determine, based on receiving vehicle data associated with a particular driver, a driver profile including information regarding a driving behavior indicative of the Particular driver;

determine, based on a wear model, associated with a vehicle component of a particular vehicle, and the driver profile, a wear rate for the vehicle component;

determine, based on the wear rate for the vehicle component and the driver profile, a service timeframe for the vehicle component;

generate, based on the service timeframe for the vehicle component, a service recommendation for the vehicle component; and transmit the service recommendation for the vehicle component to a user device.

16. The non-transitory computer-readable medium of claim 15, wherein the one or more instructions further cause the device to:

determine a vehicle profile associated with the particular vehicle.

17. The non-transitory computer-readable medium of claim 15, wherein the service timeframe for the vehicle component is further determined based on a wear threshold for the vehicle component.

18. The non-transitory computer-readable medium of claim 17, wherein the one or more instructions further cause the device to:

determine the wear threshold for the vehicle component.

19. The non-transitory computer-readable medium of claim 15, wherein the one or more instructions, that cause the device to transmit the service recommendation for the vehicle component, cause the device to:

determine a replacement vehicle component corresponding to the vehicle component; and transmit, to the user device, information identifying the replacement vehicle component.

20. The non-transitory computer-readable medium of claim 15, wherein the driver profile stores information regarding a driving location associated with the particular driver.

* * * * *